US008490668B2

(12) United States Patent
Snyder et al.

(10) Patent No.: US 8,490,668 B2
(45) Date of Patent: Jul. 23, 2013

(54) RETRACTABLE SAFETY BARRIERS AND METHODS OF OPERATING SAME

(75) Inventors: Ronald P. Snyder, Dubuque, IA (US); Jason D. Miller, Iowa Falls, IA (US); Donald P. Grant, Dubuque, IA (US); Paul J. Maly, Mequon, WI (US); Mike Gallenberger, Thiensville, WI (US); Aaron J. Wiegel, Benton, IA (US); Daniel M. Anderson, Oak Creek, WI (US); Daniel Quarles, St. Petersburg, FL (US); Eric Bublitz, Franklin, WI (US); James Oates, Mequon, WI (US); Joe Korman, Dubuque, IA (US); Matthew C. McNeill, Mequon, WI (US); Jason Dondlinger, Bellevue, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 13/299,985

(22) Filed: Nov. 18, 2011

(65) Prior Publication Data

US 2012/0061032 A1 Mar. 15, 2012

Related U.S. Application Data

(63) Continuation of application No. 12/167,885, filed on Jul. 3, 2008, now Pat. No. 8,087,443.

(60) Provisional application No. 60/948,358, filed on Jul. 6, 2007.

(51) Int. Cl.
*A47G 5/00* (2006.01)

(52) U.S. Cl.
USPC ..... 160/29; 160/23.1; 160/242

(58) Field of Classification Search
USPC .. 160/242, 24, 23.1, 29, 238, 309; 242/399.2, 242/399, 399.3, 596.8, 598.1, 598.2; 476/504, 476/490, 493, 492
See application file for complete search history.

(56) References Cited

U.S. PATENT DOCUMENTS 165,186 A 7/1875 Tower
337,582 A 3/1886 Hildreth (Continued)

FOREIGN PATENT DOCUMENTS

CA 2561113 10/2006
CN 2316435 4/1999

(Continued)

OTHER PUBLICATIONS

European Patent Office, "Office Action," issued in connection with European Patent Application No. 05 726 058.0-2311, mailed on Aug. 1, 2012, 5 pages.

(Continued)

*Primary Examiner* — Blair M. Johnson
(74) *Attorney, Agent, or Firm* — Hanley, Flight & Zimmerman, LLC

(57) ABSTRACT

A retractable barrier system includes an example gear assembly that can be manipulated for rapidly deploying a flexible barrier, exerting high torque for the initial tightening of the barrier, maintaining high static tension in barrier when in use, and/or rapidly retracting barrier for storage. In some examples, the gear assembly is a worm drive with a worm that can be selectively disengaged from a worm gear. Other optional features of the barrier system include selective right-hand/left-hand configurations, an electric switch that can be added to indicate whether the barrier system is in use, an intermediate coupling that joins the distal ends of two barriers for creating an extra long barrier system, and removable vehicle-mounted posts for certain loading dock applications.

20 Claims, 31 Drawing Sheets

U.S. PATENT DOCUMENTS

| | | | | |
|---|---|---|---|---|
| 516,486 | A | 3/1894 | Hartshorn | |
| 778,228 | A | 12/1904 | Dodge et al. | |
| 832,355 | A | 5/1905 | McDonald | |
| 824,930 | A | 7/1906 | Hopkins | |
| 1,477,159 | A | 12/1923 | Zinser | |
| 1,478,619 | A | 12/1923 | Simons et al. | |
| 1,652,186 | A | 12/1927 | Strauss | |
| 1,666,508 | A | 4/1928 | Sawyer | |
| 1,828,296 | A | 10/1931 | Sawyer | |
| 1,832,705 | A | 11/1931 | Heck | |
| RE18,940 | E | 9/1933 | Traut | |
| 2,088,046 | A | 7/1937 | White | |
| 2,295,205 | A | 9/1942 | Fraser | |
| 2,363,762 | A | 11/1944 | Wardan | |
| 2,608,042 | A | 8/1952 | Paul | |
| 2,609,042 | A | 9/1952 | Chamberlain | |
| 2,678,691 | A | 5/1954 | Rust et al. | |
| 2,747,927 | A | 5/1956 | Burkhead | |
| 2,773,547 | A | 12/1956 | Voss | |
| 3,090,425 | A | 5/1963 | Carlo | |
| 3,115,182 | A | 12/1963 | Bobbitt | |
| 3,146,824 | A | 9/1964 | Veilleux | |
| 3,187,761 | A | 6/1965 | De Maio | |
| 3,285,089 | A * | 11/1966 | Keizo Tsugawa | 74/421 R |
| 3,314,468 | A | 4/1967 | Riedel | |
| 3,581,798 | A | 6/1971 | Malamed | |
| 3,724,524 | A | 4/1973 | Potter | |
| 3,803,943 | A | 4/1974 | Woloszyk | |
| 3,868,078 | A | 2/1975 | Zinn | |
| 4,119,301 | A | 10/1978 | Payne | |
| 4,294,302 | A * | 10/1981 | Ricke, Sr. | 160/133 |
| 4,356,668 | A | 11/1982 | Wagner | |
| 4,595,155 | A | 6/1986 | Gough | |
| 4,712,599 | A * | 12/1987 | Komaki | 160/133 |
| 4,848,823 | A | 7/1989 | Flohr et al. | |
| 5,005,827 | A | 4/1991 | Steinbrecher | |
| 5,029,819 | A | 7/1991 | Kane | |
| 5,050,846 | A | 9/1991 | Goodman et al. | |
| 5,078,197 | A | 1/1992 | Weishar | |
| 5,118,056 | A | 6/1992 | Jeanise | |
| 5,170,829 | A | 12/1992 | Duncan et al. | |
| 5,271,183 | A | 12/1993 | Hahn et al. | |
| 5,299,386 | A | 4/1994 | Naegelli et al. | |
| 5,353,859 | A | 10/1994 | Oltahfer et al. | |
| 5,459,963 | A | 10/1995 | Alexander | |
| 5,503,211 | A | 4/1996 | Engi | |
| 5,505,244 | A | 4/1996 | Thumann | |
| 5,564,238 | A | 10/1996 | Ellis | |
| 5,624,203 | A | 4/1997 | Jackson et al. | |
| 5,636,679 | A | 6/1997 | Miller et al. | |
| 5,649,396 | A | 7/1997 | Carr | |
| 5,660,144 | A | 8/1997 | Venti | |
| 5,690,317 | A | 11/1997 | Sandsborg | |
| 5,752,557 | A | 5/1998 | Crider et al. | |
| 5,794,281 | A | 8/1998 | Shearon | |
| 5,823,705 | A | 10/1998 | Jackson et al. | |
| 5,875,597 | A | 3/1999 | Gingrich et al. | |
| 6,042,046 | A | 3/2000 | Beyer, Sr. | |
| 6,056,038 | A | 5/2000 | Foster et al. | |
| 6,142,701 | A | 11/2000 | Falcon | |
| 6,186,274 | B1 | 2/2001 | Reynolds et al. | |
| 6,244,324 | B1 | 6/2001 | Quates et al. | |
| 6,279,276 | B1 | 8/2001 | Knoll | |
| 6,375,164 | B1 | 4/2002 | Siegler et al. | |
| 6,375,165 | B1 | 4/2002 | Sherratt et al. | |
| 6,485,225 | B1 | 11/2002 | Baker | |
| 6,536,502 | B2 | 3/2003 | Britto et al. | |
| 6,575,435 | B1 | 6/2003 | Kotzen | |
| 6,595,496 | B1 | 7/2003 | Langlie et al. | |
| 6,601,638 | B1 | 8/2003 | Lafleur | |
| 6,688,480 | B1 | 2/2004 | Denny | |
| 6,715,973 | B2 | 4/2004 | Faber et al. | |
| 6,733,204 | B1 | 5/2004 | Paniccia | |
| 6,776,398 | B1 | 8/2004 | Tsai | |
| 6,807,999 | B1 | 10/2004 | Bowen et al. | |
| 6,830,236 | B2 | 12/2004 | Augusto de Lorenzo | |
| 6,969,185 | B1 | 11/2005 | Adair | |
| 7,207,370 | B2 | 4/2007 | Snyder et al. | |
| 7,217,061 | B2 * | 5/2007 | Stratton | 404/6 |
| 7,219,709 | B1 | 5/2007 | Williams | |
| 7,237,591 | B2 | 7/2007 | Snyder | |
| 7,337,822 | B2 | 3/2008 | Snyder et al. | |
| 7,377,490 | B1 | 5/2008 | Khosrarian | |
| 2002/0170688 | A1 | 11/2002 | Daus et al. | |
| 2003/0016966 | A1 | 1/2003 | Hattori et al. | |
| 2003/0079845 | A1 | 5/2003 | Stern, Jr. | |
| 2003/0111657 | A1 | 6/2003 | Green | |
| 2003/0164485 | A1 | 9/2003 | Olson et al. | |
| 2005/0098770 | A1 | 5/2005 | Schell | |
| 2005/0211389 | A1 | 9/2005 | Snyder et al. | |
| 2006/0151123 | A1 | 7/2006 | Chandler et al. | |
| 2006/0191644 | A1 | 8/2006 | Snyder et al. | |
| 2006/0213626 | A1 | 9/2006 | Snyder et al. | |
| 2009/0008042 | A1 | 1/2009 | Snyder et al. | |

FOREIGN PATENT DOCUMENTS

| | | |
|---|---|---|
| CN | 1956669 | 5/2007 |
| EP | 0287510 | 10/1988 |
| WO | 9713049 | 4/1997 |
| WO | 0209080 | 1/2002 |
| WO | 2005094481 | 10/2005 |

OTHER PUBLICATIONS

Canadian Intellectual Property Office, "Office Action," issued in connection with Canadian application serial No. 2,691,487, issued May 5, 2011, 3 pages.

International Seraching Authority, "Invitation to Pay Additional Fees," issued in connection with international application serial No. PCT/US2008/069219, mailed Jan. 8, 2009, 9 pages.

State Intellectual Property Office of China, "First Office Action," issued in connection with Chinese application serial No. 200880023594.0, issued Jul. 21, 2011, 6 pages.

European Patent Office, "Supplementary European Search Report," issued in connection with European application serial No. 05726058.0, issued Jan. 17, 2011, 3 pages.

International Bureau, "International Preliminary Report on Patentability," issued in connection with international application serial No. PCT/US2008/069219, issued Jan. 12, 2010, 14 pages.

United States Patent and Trademark Office, "Restriction Requirement," issued in connection with U.S. Appl. No. 12/167,885, mailed on Apr. 29, 2010, 5 pages.

United States Patent and Trademark Office, "Non-Final Office Action," issued in connection with U.S. Appl. No. 12/167,885, mailed on Jul. 20, 2010, 5 pages.

United States Patent and Trademark Office, "Final Office Action," issued in connection with U.S. Appl. No. 12/167,885, mailed on Mar. 1, 2011, 7 pages.

United States Patent and Trademark Office, "Notice of Allowance," issued in connection with U.S. Appl. No. 12/167,885, mailed on Aug. 23, 2011, 5 pages.

United States Patent and Trademark Office, "Supplemental Notice of Allowance," issued in connection with U.S. Appl. No. 10/809,119, mailed Feb. 5, 2007, 3 pages.

United States Patent and Trademark Office, "Notice of Allowance," issued in connection with U.S. Appl. No. 10/809,119, mailed Jan. 12, 2007, 16 pages.

United States Patent and Trademark Office, "Non-Final Office Action," issued in connection with U.S. Appl. No. 10/809,119, mailed May 12, 2006, 9 pages.

United States Patent and Trademark Office, "Supplemental Notice of Allowance," issued in connection with U.S. Appl. No. 11/343,010, mailed Dec. 27, 2007, 3 pages.

United States Patent and Trademark Office, "Supplemental Notice of Allowance," issued in connection with U.S. Appl. No. 11/343,010, mailed Dec. 10, 2007, 3 pages.

United States Patent and Trademark Office, "Notice of Allowance," issued in connection with U.S. Appl. No. 11/343,010, mailed Nov. 19, 2007, 8 pages.

United States Patent and Trademark Office, "Non-Final Office Action," issued in connection with U.S. Appl. No. 11/343,010, mailed Oct. 31, 2007, 5 pages.
United States Patent and Trademark Office, "Final Office Action," issued in connection with U.S. Appl. No. 11/343,010, mailed Jul. 18, 2007, 12 pages.
United States Patent and Trademark Office, "Non-Final Office Action," issued in connection with U.S. Appl. No. 11/343,010, mailed Feb. 5, 2007, 8 pages.
United States Patent and Trademark Office, "Notice of Allowance," issued in connection with U.S. Appl. No. 11/412,332, mailed Apr. 23, 2007, 16 pages.
United States Patent and Trademark Office, "Non-Final Office Action," issued in connection with U.S. Appl. No. 11/412,332, mailed Dec. 20, 2006, 7 pages.
United States Patent and Trademark Office, "Notice of Allowance," issued in connection with U.S. Appl. No. 12/167,885, mailed on Sep. 28, 2011, 2 pages.
United States Patent and Trademark Office, "Supplemental Notice of Allowance," issued in connection with U.S. Appl. No. 12/167,885, mailed on Oct. 18, 2011, 4 pages.
Gaylord Material Handling, "Dock Strap," www.callgaylord.com, retrieved May 14, 2002, 1 page.
Engination, "Rite-Hite Aftermarket Meeting," product brochure featuring safety products of JD Metalworks, Jul. 9, 2003, 8 pages.
International Searching Authority, "Search Report," issued in connection with international application serial No. PCT/US05/09600, mailed Jul. 11, 2006, 4 pages.
International Searching Authority, "Written Opinion," issued in connection with international application serial No. PCT/US05/09600, mailed Jul. 11, 2006, 3 pages.
Canadian Intellectual Property Office, "Office Action," issued in connection with Canadian application No. 2,561,113, issued Oct. 3, 2007, 2 pages.
Canadian Intellectual Property Office, "Notice of Allowance," issued in connection with Canadian application No. 2,561,113, issued Jul. 3, 2008, 1 page.
State Intellectual Property Office, P.R. China, "Second Office Action," with English translation, issued in connection with Chinese application No. 200580016919.9, issued Jan. 16, 2009, 7 pages.
State Intellectual Property Office, P.R. China, "Third Office Action," with English translation, issued in connection with Chinese application No. 200580016919.9, issued Jun. 19, 2009, 7 pages.
Mexican Patent Office, "Office Action," issued in connection with Mexican application No. PA/a/2006/0101951, issued May 12, 2009, 2 pages.
International Preliminary Examining Authority, "International Preliminary Report on Patentability," issued in connection with international application serial No. PCT/US05/09600, completed Dec. 10, 2006 (4 pages).
International Searching Authority, "Written Opinion," issued in connection with Application No. PCT/US2008/069219, May 12, 2009 (13 pages).
Canadian Intellectual Property Office, "Notice of Allowance" issued in connection with Application No. 2691487, Jan. 4, 2012 (1 page).
Canadian Intellectual Property Office, "Notification of Requisition by the Examiner in Accordance with Subsection 30(2) and Section 29 of the Patent Rules," issued in connection with Application No. 2691487, May 5, 2011 (3 pages).
Chinese Intellectual Property Office, "First Office Action," issued in connection with Chinese application No. 20101017827.X, mailed on Mar. 25, 2011, 8 pages.
State Intellectual Property Office of China, "First Office Action" in connection with application No. 200580016919.9, Jun. 6, 2008 (18 pages).
International Searching Authority, "Search Report," in connection with application No. PCT/US2008/069219, May 12, 2009 (6 pages).
Instituto Mexicano de la Propriedad Industrial, Fase Nacional de PCT Captitulo I, in connection with application No. PCT/IS2005/009600 Sep. 25, 2006 (2 pages).
Chinese Intellectual Property Office, "Office Action," issued in connection with Chinese application No. 200880023594.0, mailed on Mar. 26, 2012, 4 pages.
International Preliminary Searching Authority, International Preliminary Report on Patentability, in connection with application No. PCT/US05/09600, Jan. 31, 2007 (4 pages).
Mexican Institute of Industrial Property, "Office Action," issued in connection with Mexican application No. MX/a/2009/014082, issued Feb. 22, 2012, 3 pages.

* cited by examiner

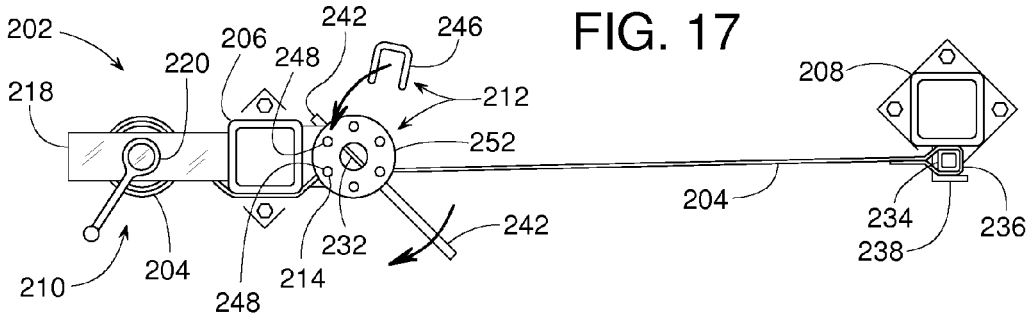
FIG. 17
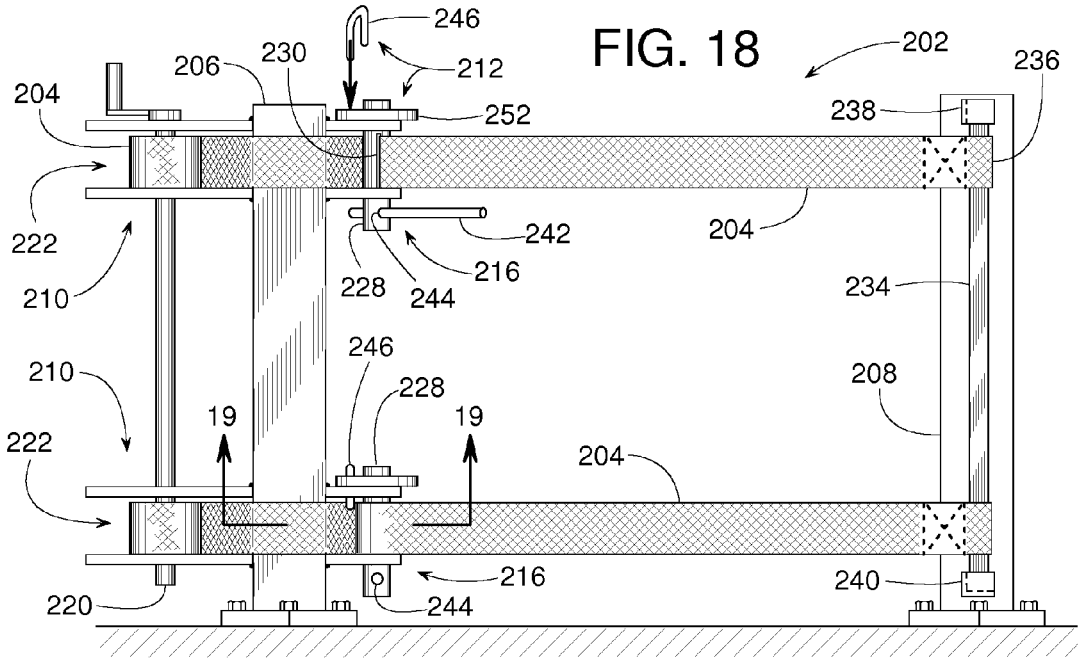
FIG. 18
FIG. 19
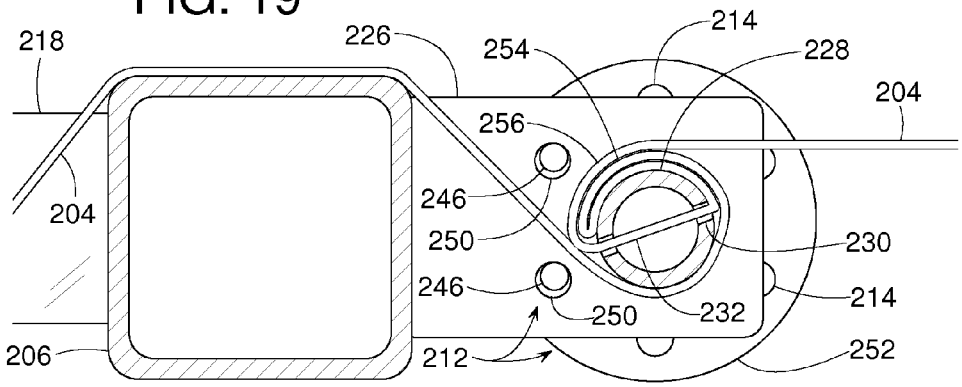

RETRACTABLE SAFETY BARRIERS AND METHODS OF OPERATING SAME

RELATED APPLICATION

This patent arises from a continuation of U.S. patent application Ser. No. 12/167,885, which claims the benefit of provisional patent application Ser. No. 60/948,358, filed Jul. 6, 2007, both of which are hereby incorporated herein by reference in their entireties.

FIELD OF THE DISCLOSURE

This disclosure relates generally to retractable safety barriers and, more specifically, to retractable safety barriers for loading dock platforms and the like.

BACKGROUND

Many retractable safety barriers for doorways have been developed to help prevent children and pets from entering certain areas. To selectively open or block a doorway, some barriers include a rollup panel that can be unrolled to extend across and block the doorway. When not in use or to allow passage, the panel can wrap about a roller for storage along one side of the doorway. A few examples of retractable barriers with rollup panels are disclosed in U.S. Pat. Nos. 5,636,679; 5,690,317; 6,536,502; 5,505,244; and 6,056,038.

Once such a rollup panel is extended across a doorway, usually some type of locking mechanism helps prevent the panel from unwrapping any farther so that the child or pet is unable to force the panel open. Such locking mechanisms typically include a little tab or pawl that engages a ratchet or some other type of tooth or slotted wheel, which in turn is coupled to the roller about which the panel is wrapped. The tab or pawl engaging the wheel hopefully prevents the roller from releasing the panel any farther. This may work well for light duty applications involving children and pets; however, such barriers do not appear adequate for industrial applications.

In factories, for example, a forklift and other material handling equipment may need to travel near operating equipment such as machine tools (machining centers, turning centers, etc.). A permanent guardrail may prevent a forklift from striking the machine, but the guardrail may also interfere with material handling equipment trying to load and unload the machine of its work pieces. While a permanent guardrail may be effective at preventing a forklift from striking a machine, forklift impact with a traditional, rigid guardrail often results in significant and permanent damage to the guardrail.

Truck loading docks may also have a need for a retractable barrier. A barrier may help prevent dockworkers and material handling equipment from accidentally falling off the edge of the dock's elevated platform. The platform's height is about the same as that of an average truck bed. Although a door typically exists at the edge of the platform, the door's strength may be insufficient to withstand the impact of a forklift, or the door may be left open for various reasons. The door, for instance, may be left open simply because the weather is nice, and the workers inside would like to enjoy some fresh air. With the door open, however, the loading dock platform may create a safety problem.

Although costly massive safety gates have been used at loading docks, they can take up a lot of space even when they are opened to allow passage through the doorway. Even though they may be able to stop a slowly moving forklift, an impact can cause considerable damage to the gate due to the gate's limited ability to resiliently absorb the impact. Also, permanent or other conventional guarding may not be suitable for loading dock areas, as such guarding may interfere with operating the door, loading and unloading trucks, and operating a dock leveler that may be installed at the platform.

A dock leveler is often installed at the loading dock platform to compensate for a height difference that may exist between the platform and the bed of the truck. A dock leveler typically includes a deck that is hinged at its back edge to raise or lower its front edge to generally match the height of the truck bed. Often an extension plate or lip is pivotally coupled to the deck to bridge the gap between the deck's front edge and a back edge of the truck bed. The deck and extended lip provide a path for forklifts to travel between the loading dock platform and the truck bed, thus facilitating loading or unloading of the truck. Unfortunately, a conventional barrier or guardrail extending over the dock leveler may restrict the deck's upward pivotal motion.

Since a dock leveler and the adjacent door move in the area where guarding may be needed, it becomes challenging to provide the area with a barrier that is movable yet sufficiently strong to impede heavy material handling equipment. Moreover, some installations require a removable guardrail that can cover a particularly long span without intermediate support posts. Covering such a span, however, can make it difficult for a single person to manually extend and retract a long flexible barrier.

BRIEF DESCRIPTION OF THE DRAWINGS

FIG. 17 is a top view similar to FIG. 15 but showing the barrier being tightened and locked in placed.

FIG. 18 is a front view of FIG. 17.

FIG. 19 is a cross-sectional view taken along line 19-19 of FIG. 18.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The methods and apparatus described herein may be advantageously used as a movable, heavy-duty industrial barrier. The methods and apparatus described herein are significantly more compact in the stored position as compared to known guardrails. Additionally, the methods and apparatus described herein are capable of being impacted by material handling equipment without significant damage. Further, the methods and apparatus described herein are relatively easy to operate single handedly and, are more cost-efficient to implement as compared to known guardrails.

Figure 1:
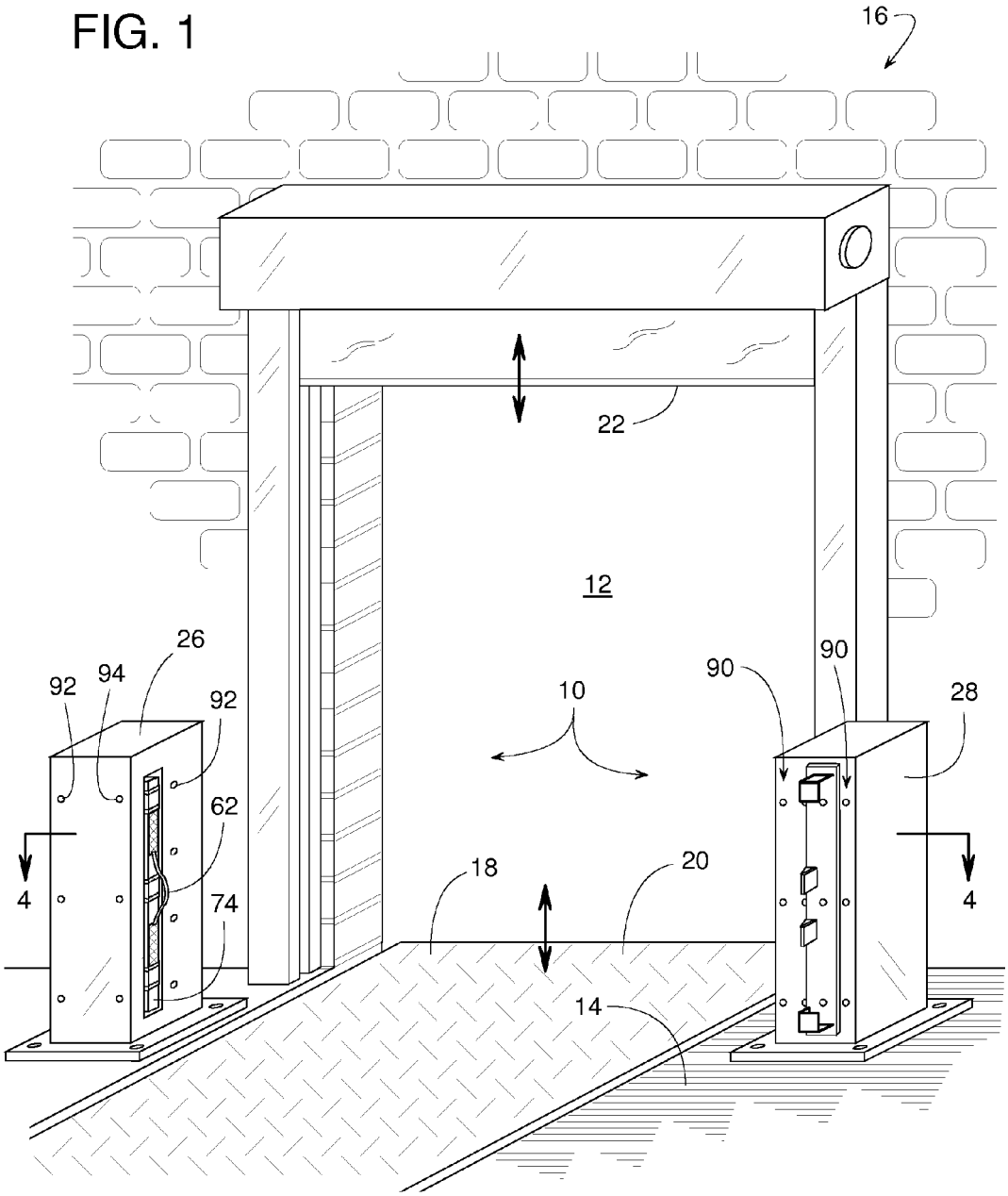
FIG. 1 is a perspective view of an example retractable barrier in an open or stored position.
Figure 2:
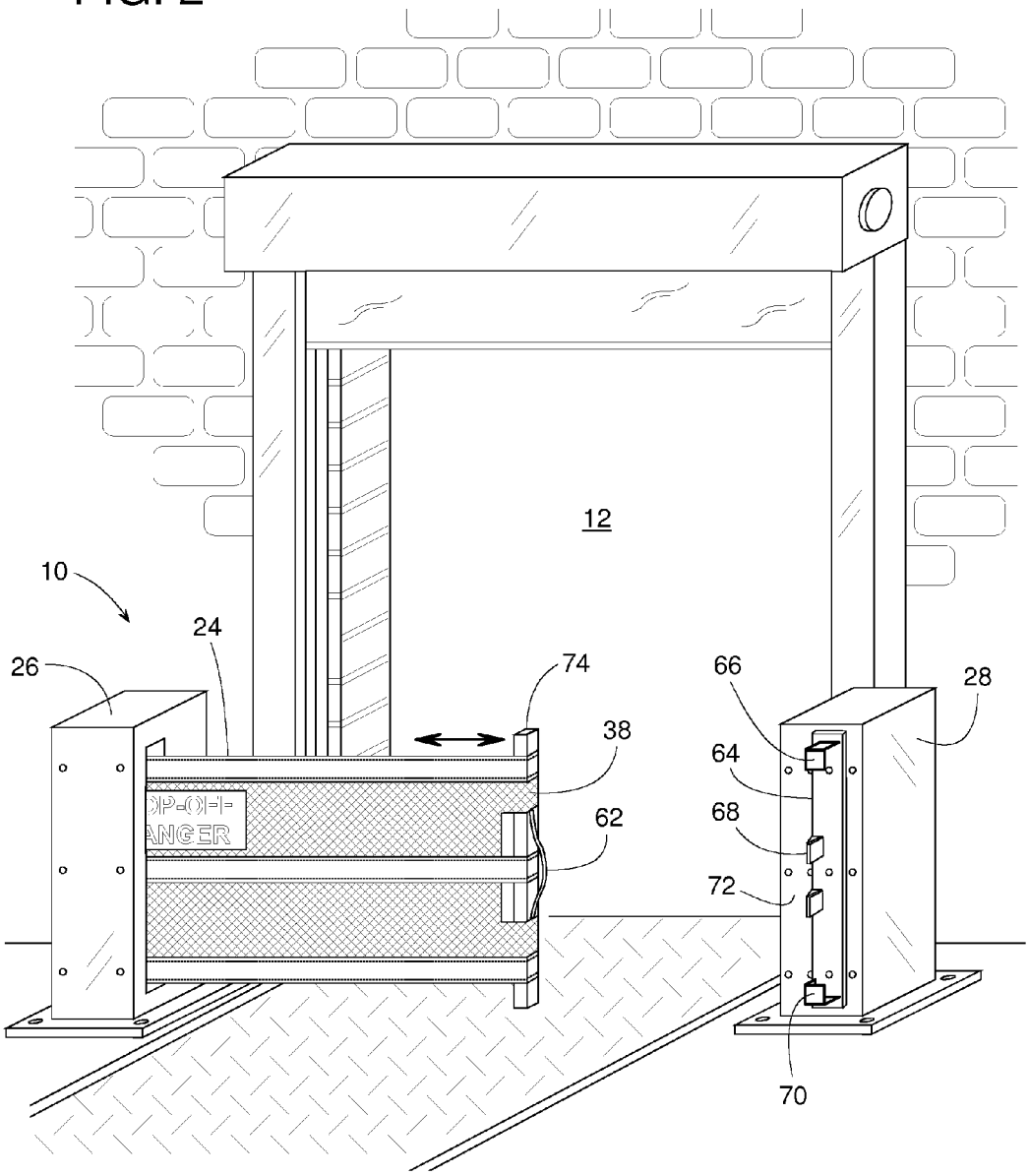
FIG. 2 is a perspective view of the retractable barrier of FIG. 1 but showing the barrier partially open.
Figure 3:
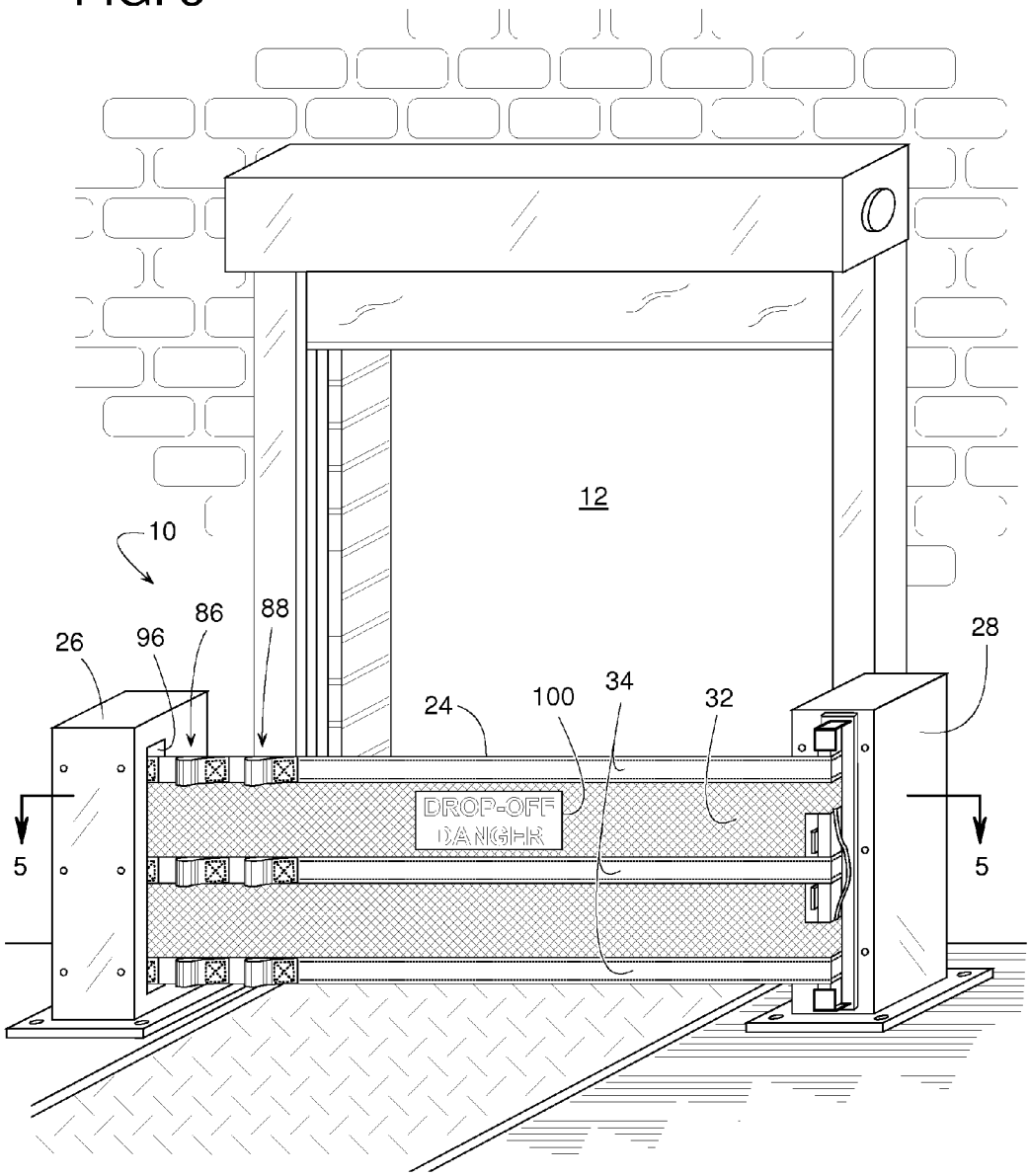
FIG. 3 is a perspective view of the retractable barrier of FIG. 1 but showing the barrier in a blocking position.

A retractable safety barrier 10 that may be advantageously used in heavy duty industrial applications is shown in FIGS. 1-3. The figures show a view from within a building looking out through an open doorway 12. FIG. 1 shows barrier 10 in an open stored position, FIG. 3 shows barrier 10 in a blocking position, and FIG. 2 shows barrier 10 partway between its open and blocking positions.

Although barrier 10 is particularly well suited for installation on an elevated platform 14 of a loading dock 16, barrier 10 can be readily applied to a broad range of heavy and light duty applications including, but not limited to, guarding machinery, guarding construction sites, restricting vehicular and pedestrian traffic, restraining cargo, restraining stock stored on high pallet racks, etc. Since the structure and function of various examples of barrier 10 may be similar regardless of the barrier's specific application, barrier 10 will be described with reference to its installation at loading dock 16.

Loading dock 16 may include a conventional dock leveler 18 whose pivotal deck 20 is presently shown at its cross-traffic position where the top surface of deck 20 is generally flush with platform 14. Loading dock 16 also includes a door 22 that can provide access to a truck parked at the loading dock 16. When a truck is not present, door 22 is normally closed and the need for barrier 10 may not be apparent; however, the strength of door 22 may be insufficient to withstand the impact of a forklift. In some cases, door 22 may be left open, as shown, even though no truck is present. If the weather outside is mild, for instance, door 22 may be left open to help ventilate the building.

Whether door 22 is open or closed while no truck is present at the loading dock 16, dock leveler 18 may create a falling hazard. A dockworker or material-handling vehicle, such as a forklift, may accidentally travel off the edge of platform 14 and fall onto the driveway just beyond doorway 12. To help prevent such an accident, some type of barrier could be installed across the doorway. The barrier, however, should preferably be movable to permit loading or unloading a truck at the loading dock 16, not interfere with the operation of the door 22, permit the operation of the dock leveler 18, and not obstruct traffic in the vicinity of the loading dock 16.

In one example implementation, barrier 10 comprises a retractable panel 24 that can selectively extend and retract between two support members, which will be referred to as a first support member 26 and a second support member 28. Support members 26 and 28 may be attached to the floor of platform 14, attached to the wall of a building, and/or connected to adjacent structure (e.g., a doorway frame, door guide, etc.), wherein the adjacent structure is in turn attached to the building wall or the floor. In some cases, support members 26 and 28 are self-supporting members, wherein the support members 26 and 28 are able to self-support their upper ends by simply having their lower ends be anchored to the floor. In some cases, support members 26 and 28 may be referred to as a "post," wherein the term "post" refers to a member whose primary source of support comes from the floor. In a currently preferred example implementation, the "retractable" feature of panel 24 is provided by panel 24 being a pliable roll-up panel that retracts by wrapping about a roller 30, wherein roller 30 is just one example of a take-up member. Other methods of retracting a panel include, but are not limited to, folding or translating interconnected sections of the panel.

Figure 4:
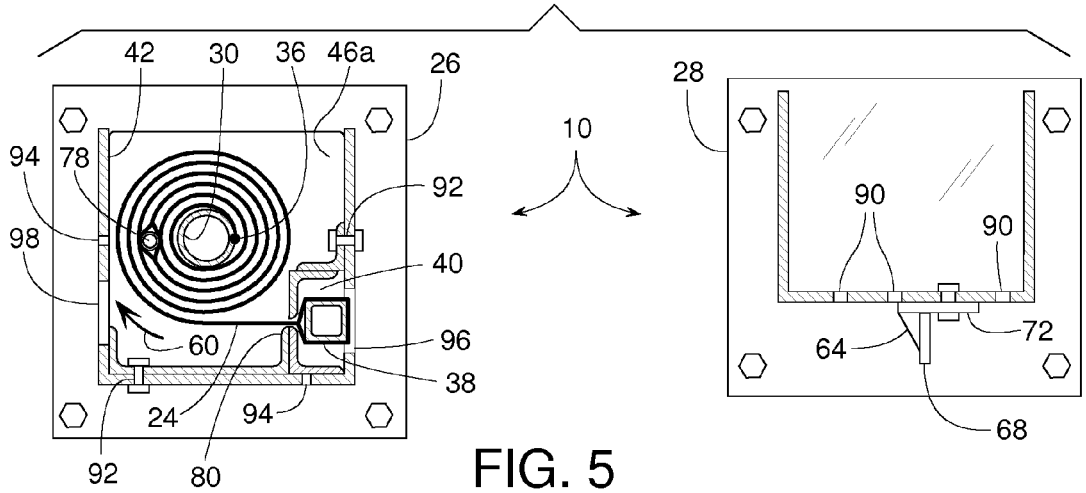
FIG. 4 is a cross-sectional view taken along line 4-4 of FIG. 1.
Figure 5:
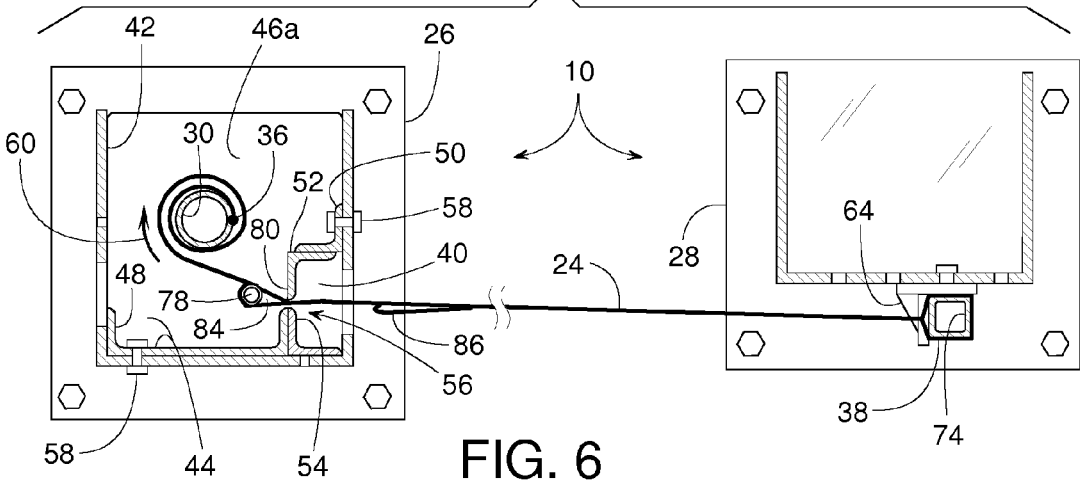
FIG. 5 is a cross-sectional view taken along line 5-5 of FIG. 3.

When panel 24 is pulled out from within first support member 26 and coupled to second support member 28, as shown in FIGS. 3 and 5, panel 24 provides a barrier that helps prevent people and vehicles from accidentally falling off the edge of platform 14. When panel 24 retracts to its stored position of FIGS. 1 and 4, barrier 10 permits normal operation of the loading dock 16.

For the illustrated example implementation of FIG. 3, panel 24 comprises a fabric web 32 reinforced by one or more straps 34 made of a nylon material or some other a high-test belting material. A proximal end 36 (FIG. 5) of panel 24 connects to roller 30, and a distal end 38 of panel 24 can be selectively stored within a pocket 40 of first support member 26 or releasably coupled to second support member 28.

In some cases, referring to FIG. 5, first support member 26 comprises a housing 42 that contains a frame 44, which in turn supports roller 30. Frame 44 comprises matching upper and lower plates 46*a* and 46*b* (FIG. 8) with vertically elongate structural members 48, 50, 52 and 54 interposed between the two plates 46*a* and 46*b*. Members 52 and 54 define a slot 56 and pocket 40. Members 48 and 50 enable conventional fasteners 58 to fasten frame 44 within housing 42. The orientation of frame 44 within housing 42 may be based on which side of the doorway first support member 26 is to be installed. This feature will be explained later.

Roller 30 is installed between the upper and lower plates 46*a* and 46*b* with panel 24 extending through slot 56. The main section of panel 24 is sufficiently thin to slide through slot 56 with the proximal end 36 of panel 24 being inside housing 42 and the distal end 38 of panel 24 being on the other side of slot 56.

To urge roller 30 to its stored position, roller 30 is preferably associated with a retracting mechanism, such as a conventional torsion spring 60, which is schematically depicted by an arrow that indicates the direction that spring 60 urges roller 30. When panel 24 disconnects from second support member 28, spring 60 acting upon roller 30 draws panel 24 into first support member 26 for storage.

Figure 6:
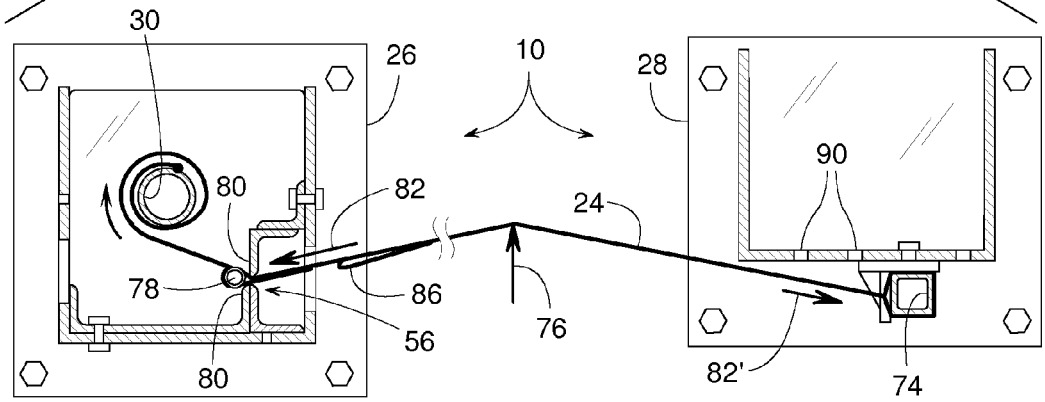
FIG. 6 is a cross-sectional view similar to FIG. 5 but showing the panel experiencing an impact.
Figure 7:
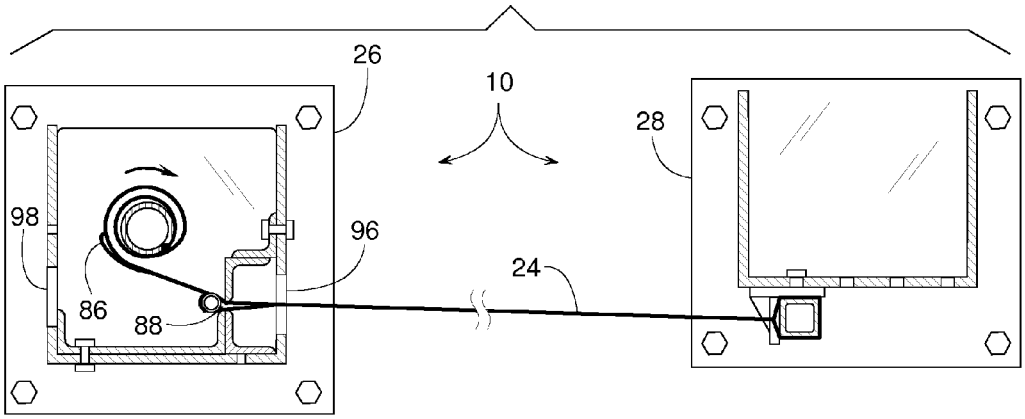
FIG. 7 is a cross-sectional view similar to FIG. 5 but with the barrier being set for a narrower doorway.

Referring to FIG. 2, to move barrier 10 to its blocking position, a pliable handle strap 62 on distal end 38 can be used to manually pull rollup panel 24 onto a hook assembly 64 of second support member 28. Hook assembly 64 includes one or more hooks, such as hooks 66, 68 and 70, which can be welded to a plate 72, which in turn is bolted or otherwise coupled to the main section of second support member 28. To couple panel 24 to second support member 28, the distal end 38 of panel 24 includes a metal bar 74 that can be hooked onto hook assembly 64. When panel 24 is in its stored position, bar 74 can stow within pocket 40 so as not to interfere with nearby traffic. When panel 24 is at its blocking position, bar 74 being vertically elongate helps distribute an impact force 76 (FIG. 6) more evenly along the vertical span of panel 24. In other example implementations, the bar 74 may be made of any other suitable material.

To prevent impact force 76 from pulling panel 24 out from within first support member 26 or damaging roller 30 and its retracting mechanism, panel 24 carries a stop member 78, such as a pipe, bar, or other structure that is too thick to fit through slot 56. The structure surrounding slot 56 serves as a catch member 80 that prevents panel 24 from pulling stop member 78 out through slot 56. Thus, most of a reactive force 82 that opposes impact force 76 passes through panel 24 and first support member 26 and bypasses roller 30 due to the interaction between stop member 78 and catch member 80. Stop member 78 is preferably vertically elongate to evenly distribute reactive force 82 across the height of panel 24.

To fit barrier 10 to various width doorways, stop member 78 can be selectively inserted into one of several possible sleeves 84, 86 or 88 that are sewn or otherwise attached to panel 24. In this example, each sleeve 84, 86 and 88 comprises three vertically spaced apart loops formed of the same material as the panel's reinforcing straps. Stop member 78 is inserted in the selected sleeve while that sleeve is on the roller side of slot 56, thus the chosen sleeve determines how far panel 24 can extend out from within first support member 26. In other example implementations, panel 24 may be provided with any number of sleeves (e.g., 1, 2, 3, 4, etc.) that may include any number of loops.

The horizontal spacing between sleeves 84, 86 and 88 enables the length of barrier 10 to be adjusted in discrete increments equal to the spacing between adjacent sleeves 84, 86 and 88. Finer length adjustments can be achieved by changing the location of where mounting plate 72 of hook assembly 64 is attached to second support member 28. In selecting a location, second support member 28 includes several series of mounting holes 90 from which to choose. The actual spacing between adjacent sleeves of panel 24, and the spacing between adjacent vertical rows of mounting holes 90 can vary depending on the design; however, in some examples, sleeves 84, 86 and 88 are spaced at twelve-inch increments, and the rows of mounting holes 90 are horizontally spaced at three-inch increments, so the extended length of panel 24 can be adjusted in three-inch increments over a length of 24 inches.

Figure 8:
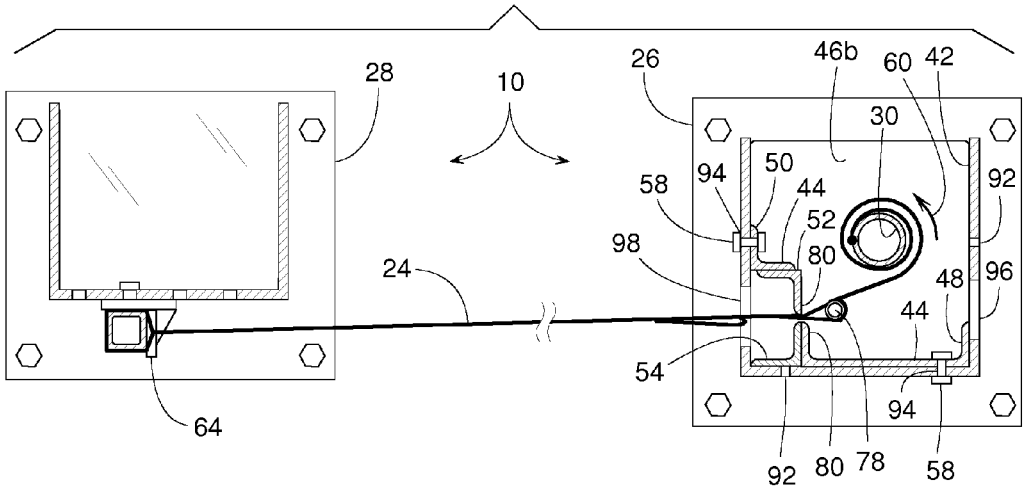
FIG. 8 is a cross-sectional view similar to FIG. 5 but with the location of the barrier's two support members being interchanged.

Minor reconfiguration of support members 26 and 28 allow interchanging their locations so that either support member 26 or 28 can be on the right or left side of a doorway 12. For doorway 12, for example, support members 26 and 28 can be reinstalled as shown in FIG. 8. To do this, frame 44 is inverted on first support member 26, and hook assembly 64 is inverted on second support member 28. Hook assembly 64 can be inverted by using the same mounting holes 90. To permit the inverted installation of frame 44, however, housing 42 is provided with two sets of mounting holes 92 and 94 from which to choose. Housing 42 also includes a right-hand opening 96 and a similar left-hand opening 98 through either of which panel 24 can extend depending on the orientation of frame 44 within housing 42. While the components of the retractable safety barrier system may be configured in various ways, the system preferably includes a first support member, a second support member spaced from the first support member, a resilient barrier capable of spanning between the support members, a take-up member coupled to the resilient barrier, and an incremental stop means coupled to the resilient barrier such that most of the impact is reacted by the first support member.

To warn others in the area of loading dock 16 that a drop-off hazard may exist, even when door 22 is closed, panel 24 may be of contrasting colors (e.g., red and yellow, black and yellow, etc.). In some examples, for instance, straps 34 are yellow and web 32 is red. Alternatively or in addition to, a warning label 100 can be prominently displayed on panel 24 to suggest that a safety hazard exists.

Figure 9:
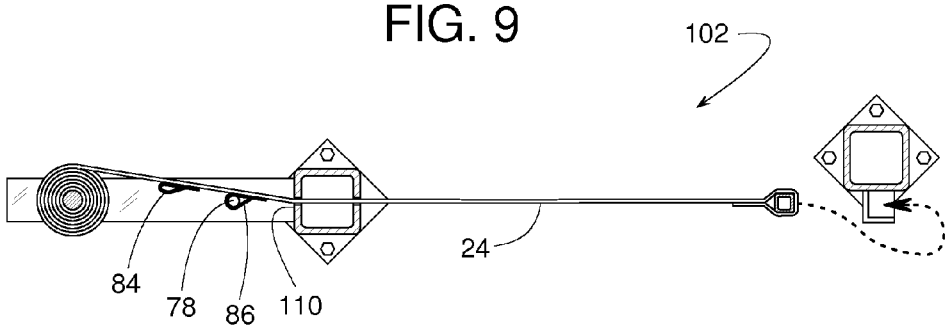
FIG. 9 is a cross-sectional view taken along line 9-9 of FIG. 10.
Figure 10:
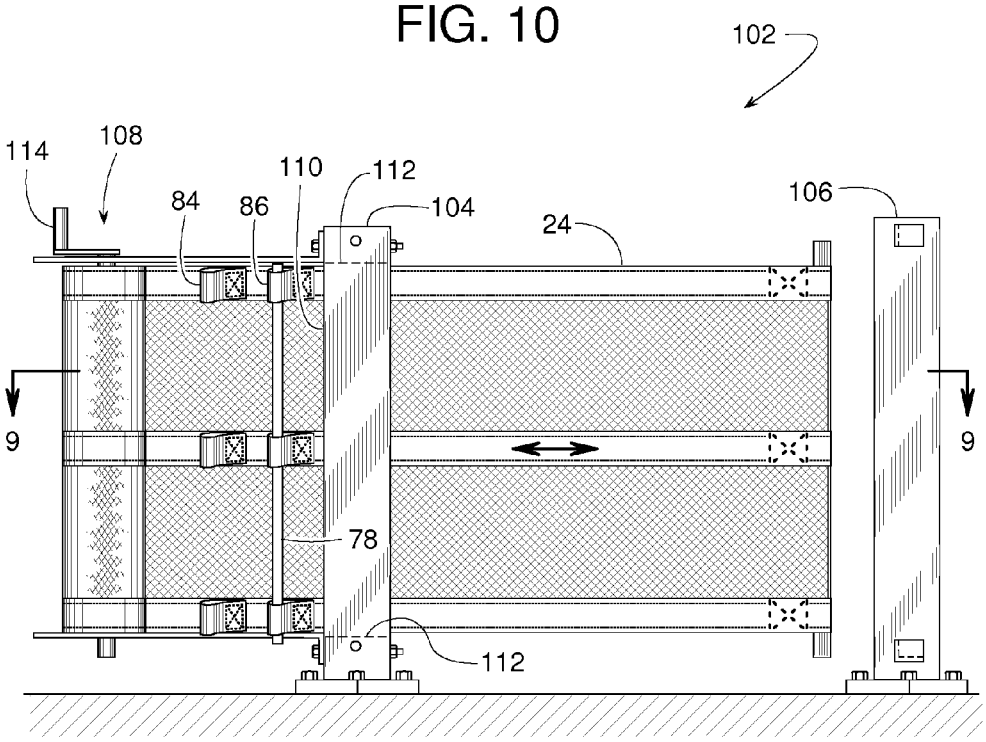
FIG. 10 is a front view of another example of a retractable barrier.

FIGS. 9 and 10 illustrate an alternate barrier system 102 that is similar to barrier 10 but without housing 42. Barrier system 102 comprises two force-reacting support members 104 and 106, a take-up member 108 in the form of a roller for storing the unused portion of flexible barrier 24 (retractable fabric panel, multiple straps, single strap, etc.), and stop member 78 that works in conjunction with a catch member 110 for limiting the extent to which barrier 24 can be extended and for transferring impact forces from barrier 24 to support member 104. To create catch member 110, support member 104 includes a slot 112 that is sized to receive barrier 24 but is too narrow for stop member 78. Stop member 78 can be selectively inserted in loops 84 or 86 to adjust the stop position of barrier 24. A crank 114, spring, or some other type of recoil mechanism can be added to help rewind barrier 24 onto take-up member 108. In this example, take-up member 108 is mounted to support member 104; however, take-up member 108 could alternatively be mounted to its own separate support column.

Figure 11:
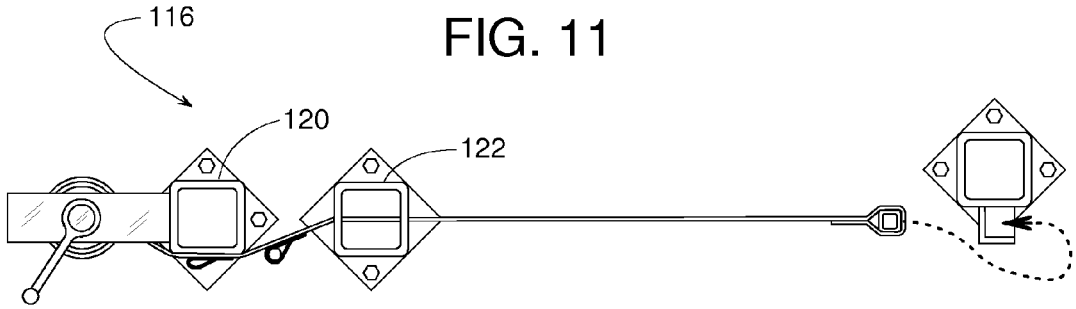
FIG. 11 is a top view of FIG. 12.
Figure 12:
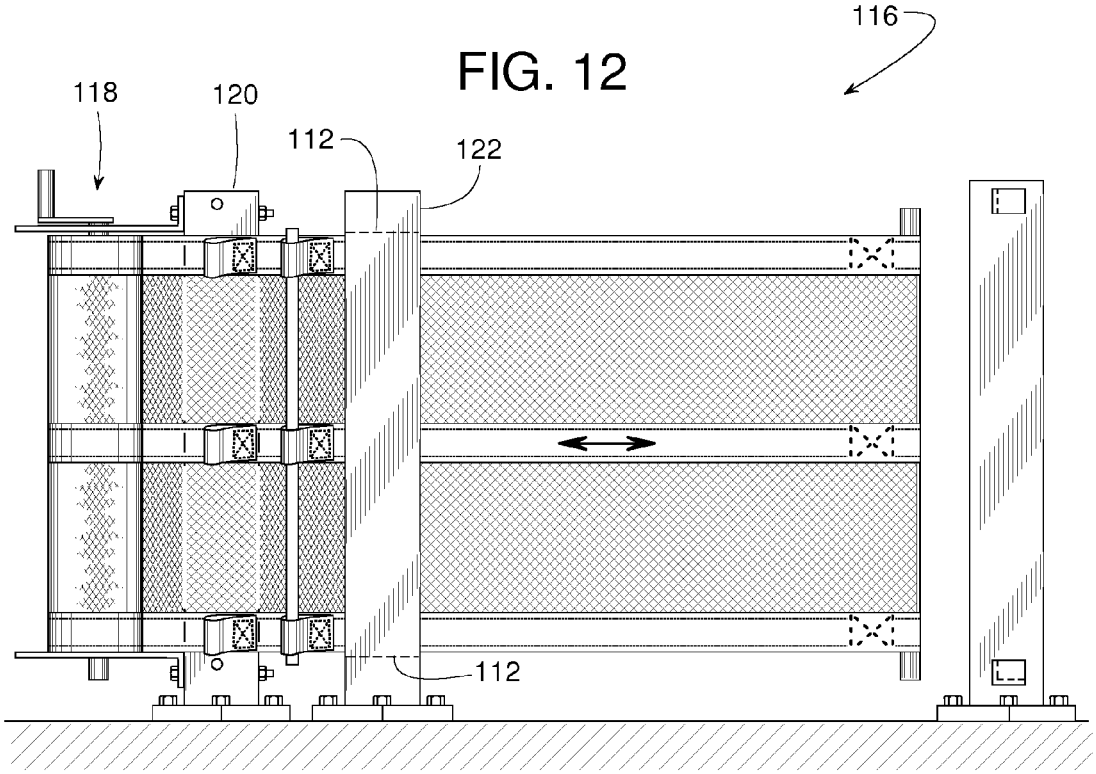
FIG. 12 is a front view of another example of a retractable barrier.
Figure 13:
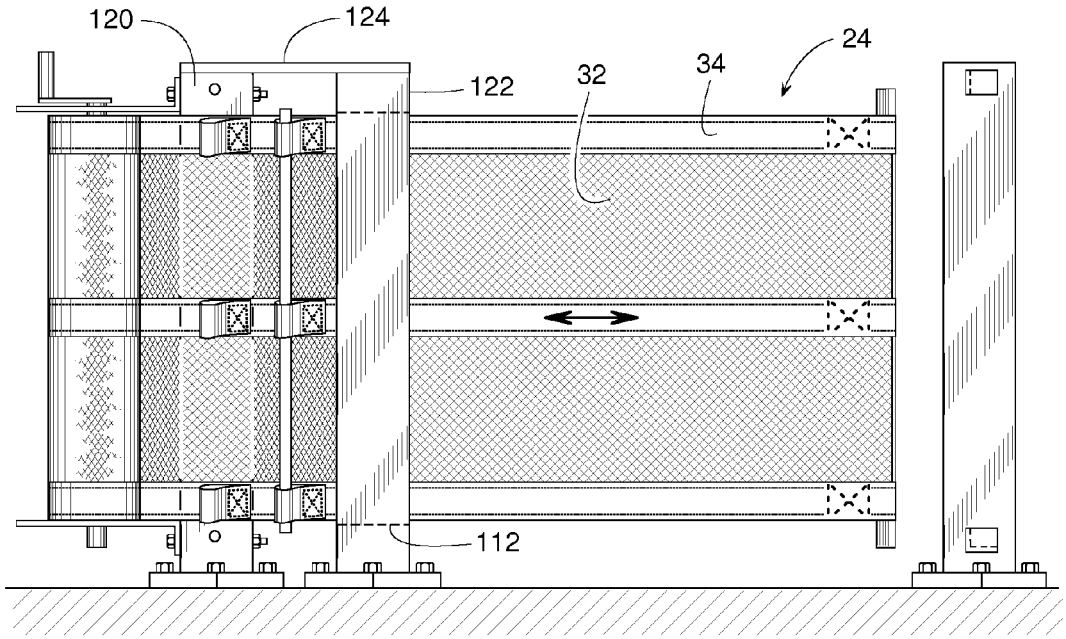
FIG. 13 is a front view of another example of a retractable barrier.

For barrier system 116 of FIGS. 11 and 12, for instance, a take-up member 118 is mounted to a separate post 120 that can be anchored to the floor at a position spaced apart from a force-reacting support member 122. For greater strength and rigidity, post 120 and support member 122 can be connected by one or more cross-members 124 to create a double-post structure, as shown in FIG. 13. With cross-member 124, post 120 can help support member 122 in reacting to an impact against panel 24.

Figure 14:
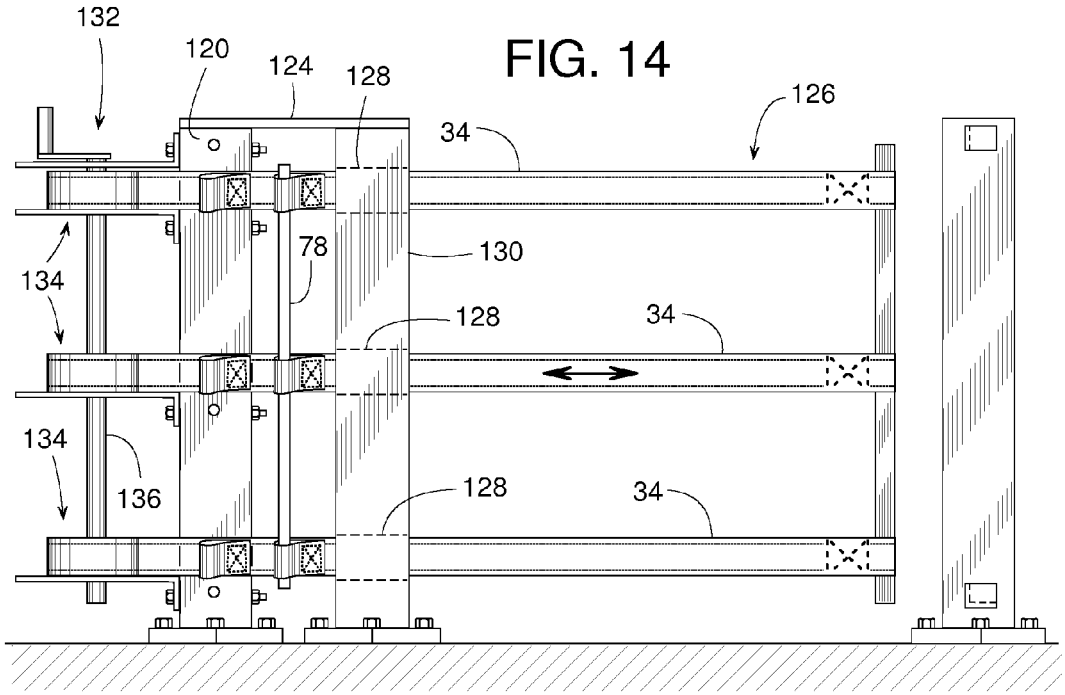
FIG. 14 is a front view of another example of a retractable barrier.
Figure 15:
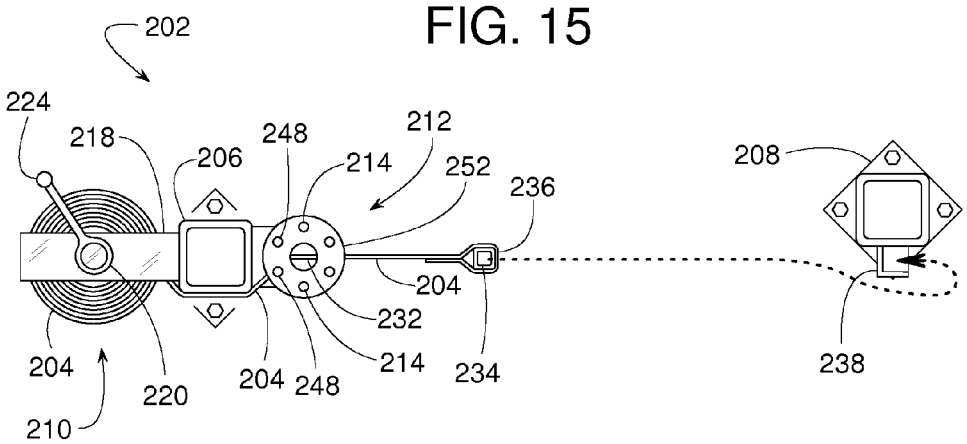
FIG. 15 is a top view of an example retractable barrier being extended to a second support member from an open or stored position on a first support member.
Figure 16:
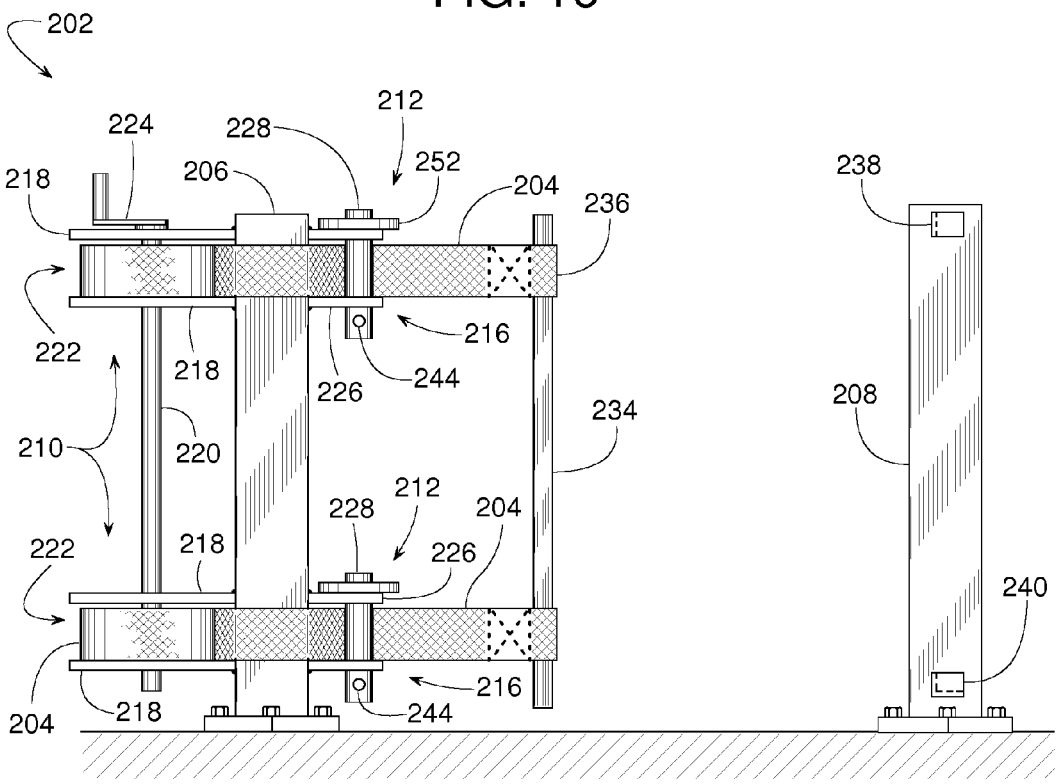
FIG. 16 is a front view of FIG. 15.

FIG. 14 is similar to FIG. 13; however, web 32 is omitted to create a barrier 126 that comprises one or more straps 34. The individual straps 34 feed through corresponding individual slots 128 in a support member 130 rather than feeding through one long slot 112 in support member 122 of FIGS. 12 and 13. To support the unused portions of the individual straps 34, a take-up member 132 includes a corresponding number of individual rollers 134. Rollers 134 could rotate in unison by sharing a common shaft 136, as shown. Alternatively, rollers 134 could be set up to rotate independently of each other. It should be noted that post 120 and cross-member 124 could be eliminated by mounting take-up member 132 to support member 130, similar to barrier system 102 of FIGS. 9 and 10.

In another example implementation, shown in FIGS. 15-19, a barrier system 202 includes a retractable panel, such as a strap 204, which can be stored at a first support member 206 when not in use or extended between first support member 206 and a second support member 208 when in use. Attached to first support member 206 is a first take-up member 210 for storing strap 204, an incremental stop mechanism 212 for providing strap 204 with a plurality of spaced-apart stopping points 214, and a second take-up member 216 for adjusting the tension in strap 204 with infinite adjustability.

Although the actual structure of first take-up member 210, second take-up member 216, and incremental stop mechanism 212 may vary, in some examples, first take-up member 210 comprises a plurality of arms 218 attached to first support member 206. A vertical rod 220 extends through arms 218 to create one or more spools 222 about which one or more straps 204 can be wrapped for storage. A crank 224 can be attached to rod 220 to make it easier to wrap straps 204 onto spools 222.

Second take-up member 216 may also comprise a plurality of arms 226 attached to first support member 206. Upper and lower pins 228 are supported for rotation within arms 226, and each pin 228 has a slot 230 through which a section 232 of strap 204 extends so that straps 204 wrap around their respective pins 228 upon rotating the pins 228. When a bar 234 at a distal end 236 of straps 204 engages hooks 238 and 240 on second support member 208, as shown in FIGS. 17 and 18, straps 204 can be tightened in tension by rotating pins 228. To rotate pins 228 with greater torque, a removable lever arm 242 can be inserted through a hole 244 in pin 228. Two separate pins 228 enable straps 204 to be tightened and locked individually.

Once straps 204 are tightened, incremental stop mechanism 212 firmly holds pins 228 and straps 204 at their tightened positions so that straps 204 and second take-up member 216 can react to an impact against straps 204 without having to rely on a frictional locking mechanism. Moreover, incremental stop mechanism 212 enables second take-up member 216 and first support member 206 to react to the impact rather than transferring the impact to the relatively light duty first take-up member 210.

In some examples, incremental stop mechanism 212 comprises an alignment pin 246 that can be inserted through aligned holes 250 and 248 respectively in arm 226 and a flange 252 attached to pin 228, thereby locking flange 252 to arms 226. When alignment pin 246 is removed, flange 252 and holes 248 can rotate with pin 228, while arms 226 and holes 250 remain stationary. Alignment pin 246 can be a single linear pin, a U-shaped pin, or some other appropriate shape.

While incremental stop mechanism 212 provides a plurality of discrete, spaced-apart stopping points 214 defined by holes 248 in flange 252, second take-up member 216 can be operated such that a variable amount of strap 204 can be wrapped onto pin 228 to provide infinitely variable tension adjustment of strap 204. Referring to FIG. 19, a portion or folded portion 254 of strap 204, for example, can be folded onto itself to infinitely vary the effective length of strap 204. The folded portion 254 of strap 204 can be strapped in place by rotating pin 228 until a sufficient amount of additional strap 256 overlies the folded portion 254, whereby the folded portion 254 becomes clamped between pin 228 and the additional portion 256 of strap 204. The selectively variable length of folded portion 254 is what provides infinite adjustment between the spaced-apart stopping points 214. It should be noted that the length of folded portion 254 could extend multiple revolutions around pin 228 depending on the extent to which pin 228 is rotated.

Figure 20:
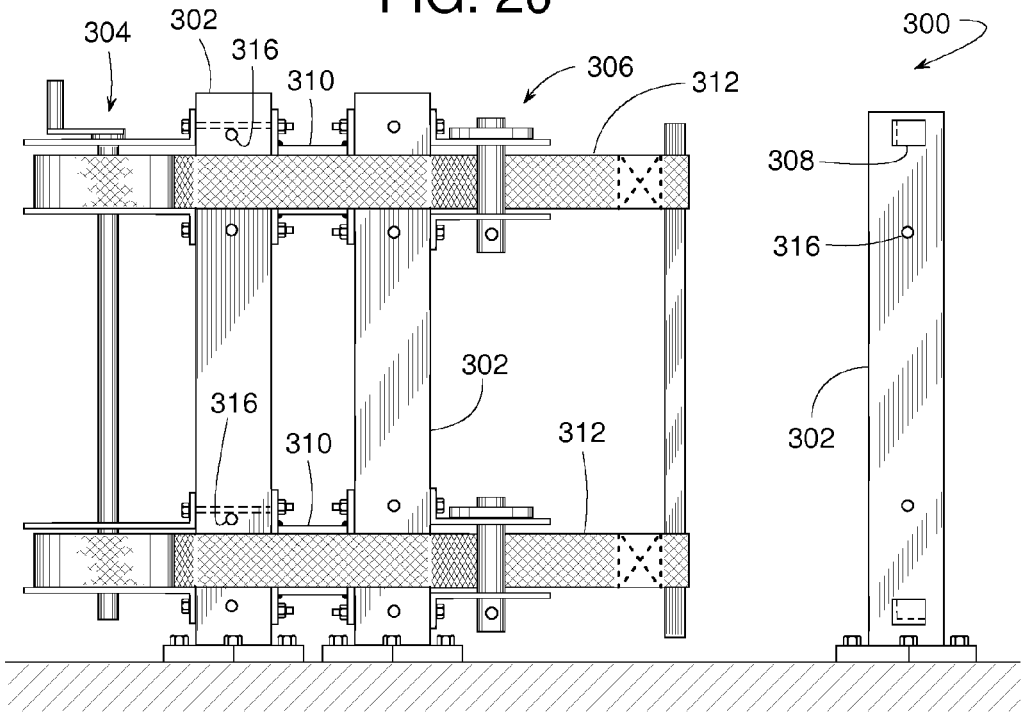
FIG. 20 is a front view of another example of a retractable barrier.

Many of the features illustrated in FIGS. 1-19 can be selectively chosen and combined in different ways to create numerous other examples. A modular, bolt-together barrier system 300 of FIG. 20, for instance, is similar to barrier system 102 of FIGS. 15-19; however, barrier system 300 is shown assembled as a double-post design similar to FIGS. 13 and 14.

Figure 21:
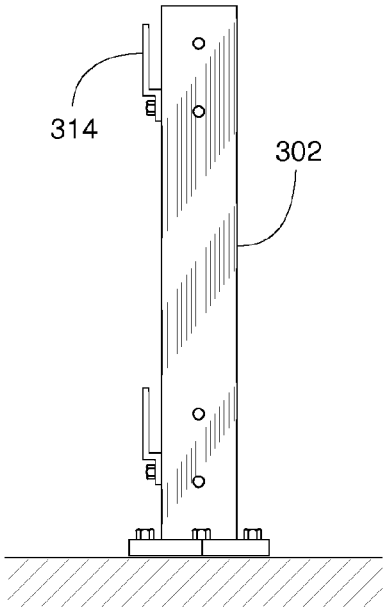
FIG. 21 is a front view of a post with a bracket mounted to it.
Figure 22:
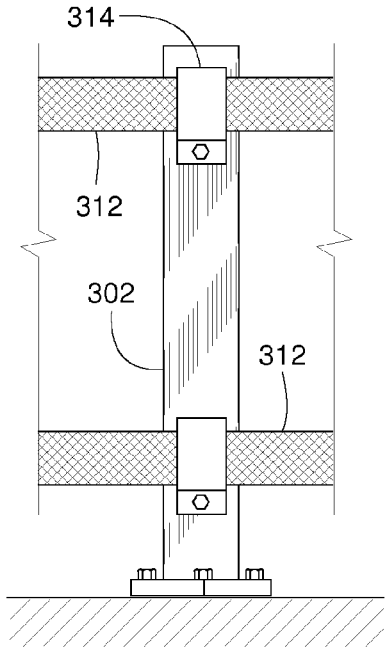
FIG. 22 is a side view of FIG. 21.

Modular components of barrier system 300 include a post 302 (similar to post 120 of FIG. 12), a take-up member 304 (similar to first take-up member 210), stop member 306 (similar to incremental stop mechanism 212), a retainer 308 (similar to hook assembly 64 or hooks 66, 68 or 70), and a cross-member 310 (similar to cross-member 124), and a barrier 312 (similar to barrier 126 of FIG. 14). Referring further to FIGS. 21 and 22, barrier system 300 may also include a strap support bracket 314 that can be bolted to post 302. Bracket 314 and post 302 can be used to help support barriers 312 at some intermediate position along the barrier's 312 length.

To facilitate the modularity of barrier system 300, post 302 includes a plurality of cross-drilled thru-holes 316 for mounting take-up members 304, cross-members 310, stop members 306, retainers 308, and brackets 314 in various configurations. One set of holes 316 passes through post 302 in one direction and another set runs perpendicular to the first. One set is a bolt-diameter higher than the other so that two perpendicular bolts can pass through post 302 at approximately the same elevation without interference.

Figure 23:
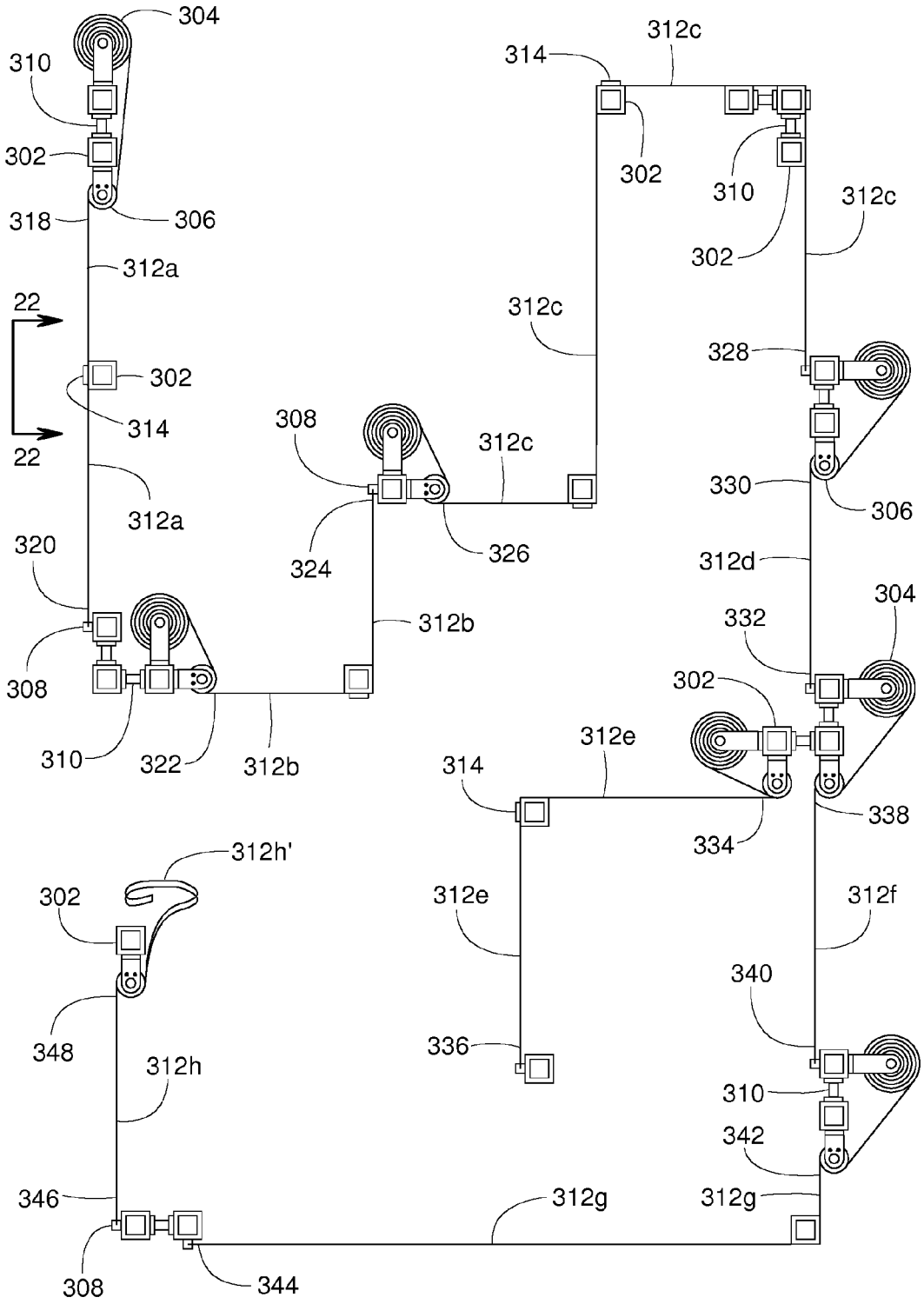
FIG. 23 is a schematic top view showing various configurations of an example modular barrier system.

The modular components of barrier system 300 can be assembled in an infinite number of configurations. FIG. 23 illustrates just one possible layout. In this example, a barrier 312*a* is held in tension between points 318 and 320, a barrier 312*b* is held in tension between points 322 and 324, a barrier 312*c* is held in tension between points 326 and 328, a barrier 312*d* is held in tension between points 330 and 332, a barrier 312*e* is held in tension between points 334 and 336, a barrier 312*f* is held in tension between points 338 and 340, a barrier 312*g* is held in tension between points 342 and 344, and a barrier 312*h* is held in tension between points 346 and 348. In some cases, to avoid the cost of take-up member 304, an unused portion 312*h*' of the barrier may be left just lying on the floor, as shown, or stored in some other uncoiled fashion.

As detailed above, the geometry of the individual components of the retractable safety barrier system may vary, and the components may be assembled in a variety of ways. However, each example implementation of the retractable barrier system disclosed above preferably includes a first support member, a second support member spaced from the first support member, a resilient barrier capable of spanning between the support members, a take-up member coupled to the resilient barrier to selectively take-up the resilient barrier, and an incremental stop means coupled to the resilient barrier such that most of the impact is reacted by the first support member. The term, "resilient" refers to a material that is flexible or pliable but not necessarily springy.

Figure 25:
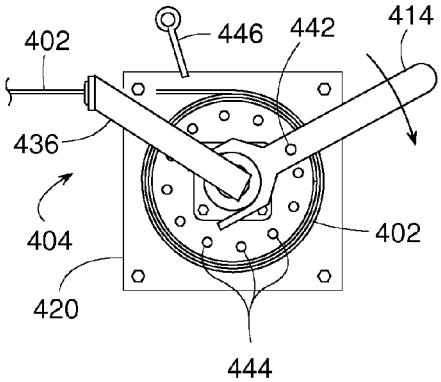
FIG. 25 is a top view of the barrier system of FIG. 24 being tightened.
Figure 26:
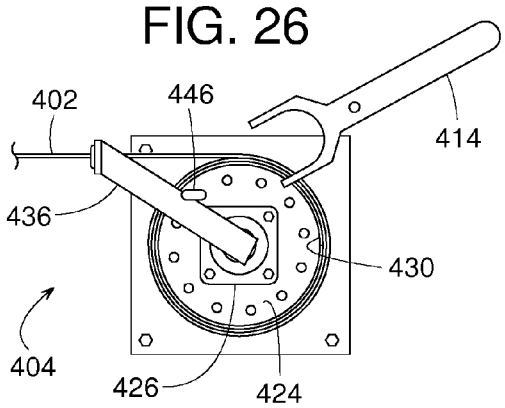
FIG. 26 is a top view similar to FIG. 25 but with the system already tightened.
Figure 24:
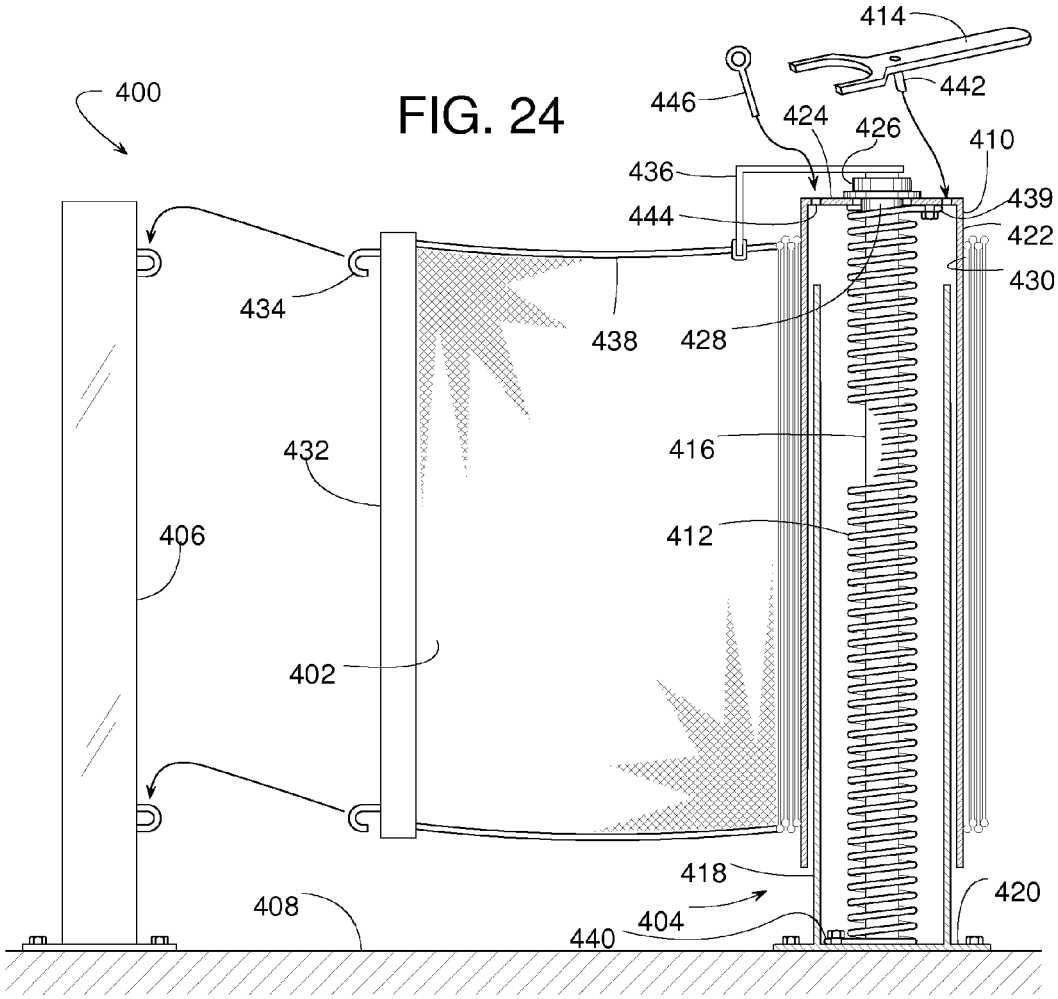
FIG. 24 is a cross-sectional front view of another example barrier system.

FIGS. 24-26 show a retractable barrier system 400 comprising a flexible barrier 402 that can selectively extend and retract between a first support member 404 and a second support member 406. Supports members 404 and 406 are shown mounted to a floor 408; however, they could also be attached to or combined with an existing column or wall of a building. Flexible barrier 402 is schematically illustrated to represent any structure that can be wrapped about a roll or drum. Barrier 402, for instance, can be made of a single sheet of pliable material or netting or be comprised of one or more straps.

To assist in wrapping barrier 402 about a rotatable take-up member 410, first support member 404 includes a coil spring 412 that helps maintain at least some tension in barrier 402. When barrier 402 is fully extended between supports members 404 and 406, a wrench 414 functioning as a manual crank mechanism can be used to further tighten barrier 402.

In some example implementations, first support member 404 comprises a central pipe 416 and a stationary tube 418 attached to a base plate 420. Take-up member 410 comprises a rotatable outer tube 422 with an end cap 424 to which the outer race of a bearing 426 is mounted. The upper end of pipe 416 protrudes upward through a hole in end cap 424 and also protrudes through the inner race of bearing 426. The inner race of bearing 426 rests upon a shoulder 428 on pipe 416 so that take-up member 410 is rotatably supported by pipe 416.

A proximal end 430 of barrier 402 is fastened to outer tube 422, and a distal end or edge 432 of barrier 402 includes an attachment feature 434 for releasably connecting to second support member 406. To help guide barrier 402 onto outer tube 422, a guide member 436 mounted to the upper end of pipe 416 slidingly engages a bead or upper edge 438 that runs along the upper edge of barrier 402.

To apply a rotational moment on outer tube 422 relative to stationary tube 418 and ultimately apply tension to barrier 402, coil spring 412 has one end 439 attached to end cap 424 or outer tube 422, and an opposite end 440 of spring 412 is attached to base plate 420 or stationary tube 418. As barrier 402 is manually drawn off of outer tube 422, outer tube 422 rotates, thereby twisting spring 412 and increasing the tension in barrier 402.

FIG. 24 shows distal edge 432 of barrier 402 being manually pulled toward second support member 406. After distal edge 432 is latched onto second support member 406, a pin 442 protruding downward from wrench 414 is inserted into one of a plurality of pin holes 444 in end cap 424, and wrench 414 can then be manually rotated as shown in FIG. 25. The rotation of wrench 414 turns outer tube 422, which tightens barrier 402. Once barrier 402 is sufficiently tight, the tension in barrier 402 can be maintained by inserting a lock pin 446 into one of pin holes 444 such that lock pin 446 engages the side edge of guide member 436, thus limiting the rotation of outer tube 422 and allowing wrench 414 to be removed and stored elsewhere, as shown in FIG. 26.

Figure 28:
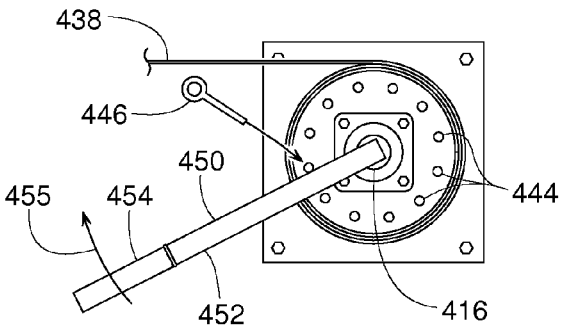
FIG. 28 is a top view of the barrier system of FIG. 27 being tightened.
Figure 29:
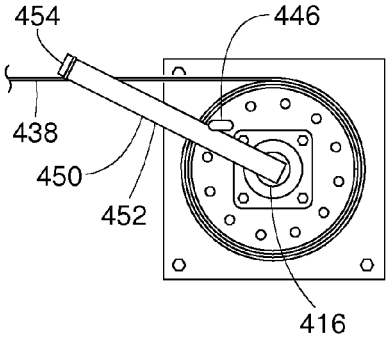
FIG. 29 is a top view similar to FIG. 27 but with the system already tightened.
Figure 27:
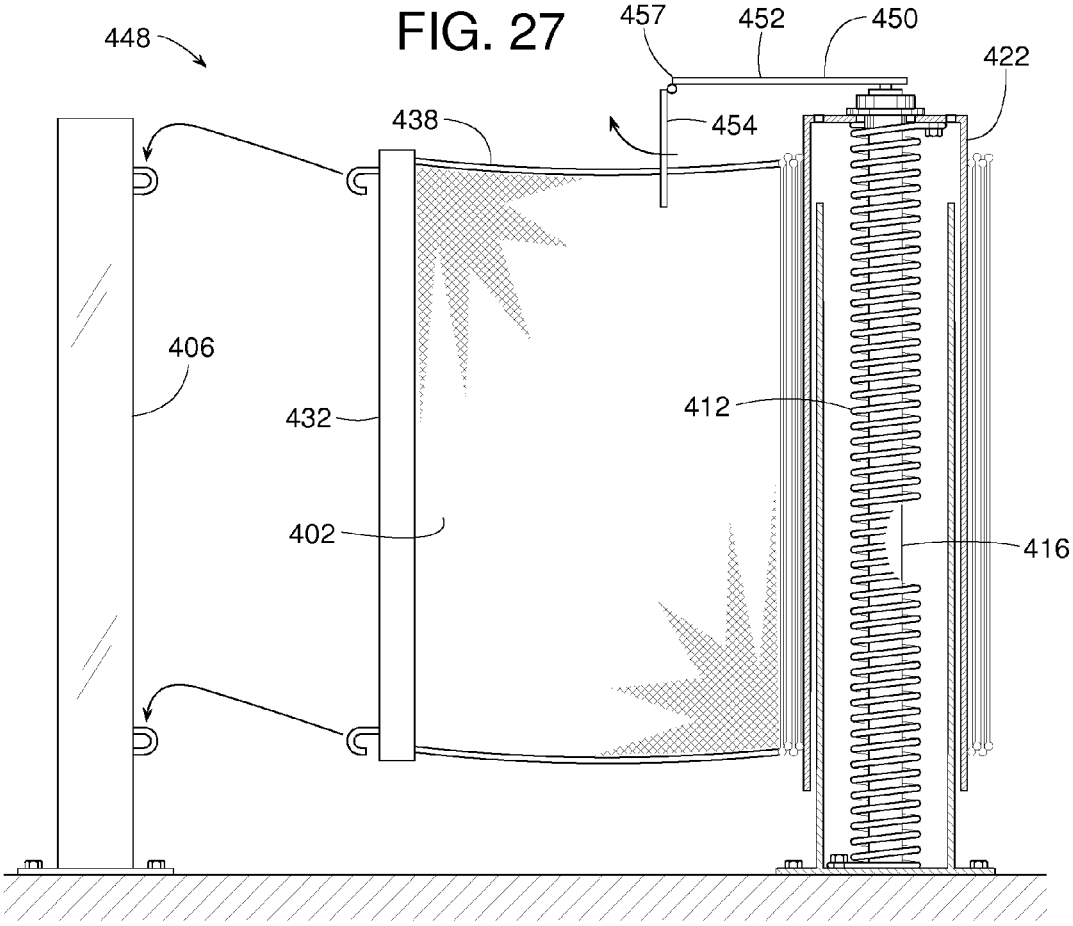
FIG. 27 is a cross-sectional front view of alternate example barrier system similar to that of FIG. 24.

In a similar barrier system 448, shown in FIGS. 27-29, a different manual crank mechanism 450 eliminates the need for wrench 414. Mechanism 450 comprises a lever arm 452 rotatably pinned to pipe 416 and a handle 454 hinged to an outer end 457 of lever arm 452. To tighten barrier 402 after distal edge 432 is latched onto second support member 406, lock pin 446 is inserted into one of holes 444, handle 454 is manually pivoted upward above the upper edge 438 of barrier 402, and handle 454 and lever arm 452 are rotated in the direction of arrow 455 to engage lock pin 446 and rotate outer tube 422, thereby tightening barrier 402. Once barrier 402 is sufficiently taut, handle 454 is pivoted back down where the face of the tightened barrier 402 can engage the downwardly extending handle 454, as shown in FIG. 29, thereby preventing outer tube 422 and spring 412 from unwinding.

Figure 30:
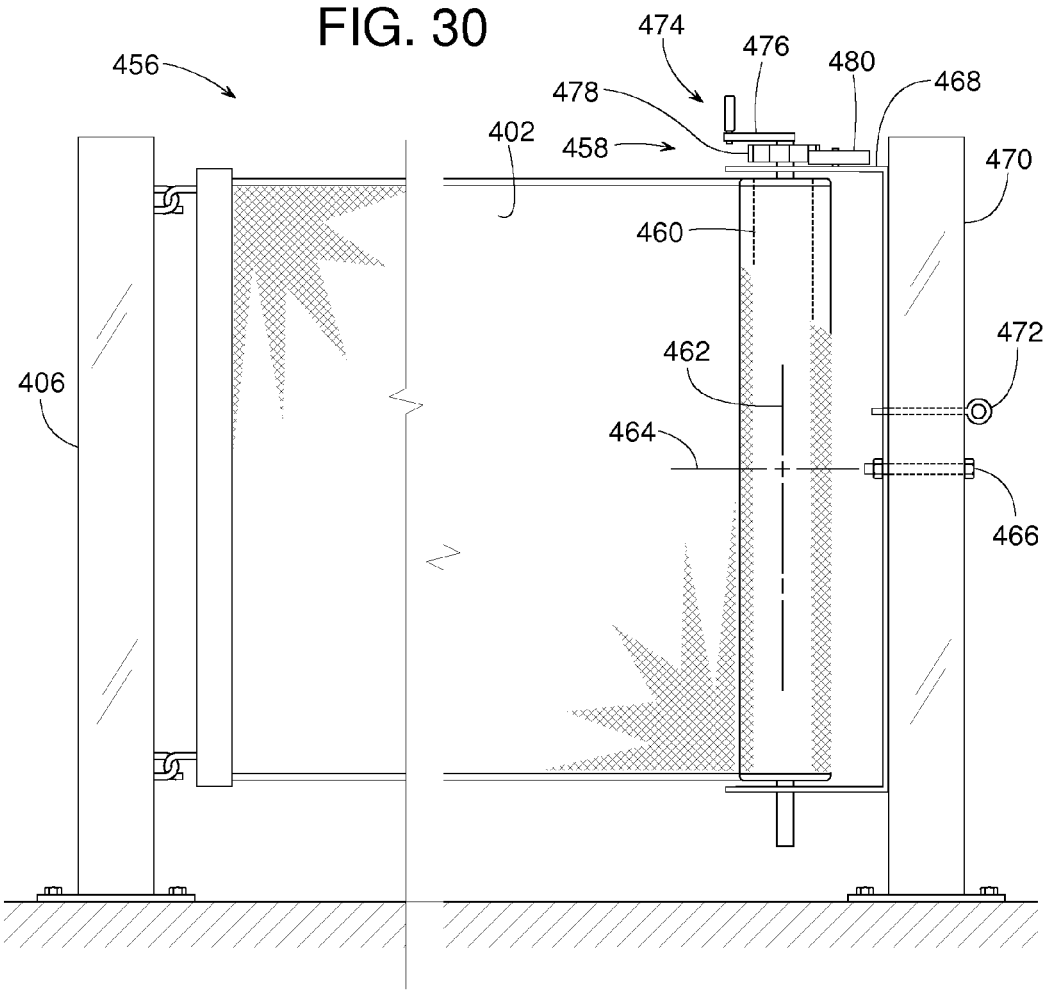
FIG. 30 is a front view of a barrier system in its extended position.

In some cases, the span between a barrier's two support members can be particularly long, which can make winding and unwinding of the barrier awkward, as the barrier tends to uncontrollably flop over to one side or the other. Wrapping a flexible barrier onto a vertical take-up drum is particularly difficult, as the barrier tends to "migrate" to the bottom of the drum. To address this problem, a barrier system 456 shown in FIGS. 30-32, includes a take-up member 458 with a drum 460 that in addition to rotating about a first axis 462 can also be rotated about a second axis 464. Second axis 464 allows barrier 402 to be deliberately laid over on a preferred side (FIG. 31) as the barrier is being extended or retracted. The preferred side might be such that the side facing down, and perhaps getting dirty from the floor, is the side of the barrier 402 that is least visible when barrier 402 is fully extended and upright (FIG. 30).

Rotation about second axis 464 can be achieved by using a bolt 466 or some other appropriate fastener to pivotally mount a drum-supporting frame 468 of take-up member 458 to a support member 470. A retractable lock pin 472 or some other suitable device can be used to help hold frame 468 to its upright and/or laid-over position. Although axes 462 and 464 are shown perpendicular and intersecting, the two axes do not necessarily have to be perpendicular or intersecting.

Figure 32:
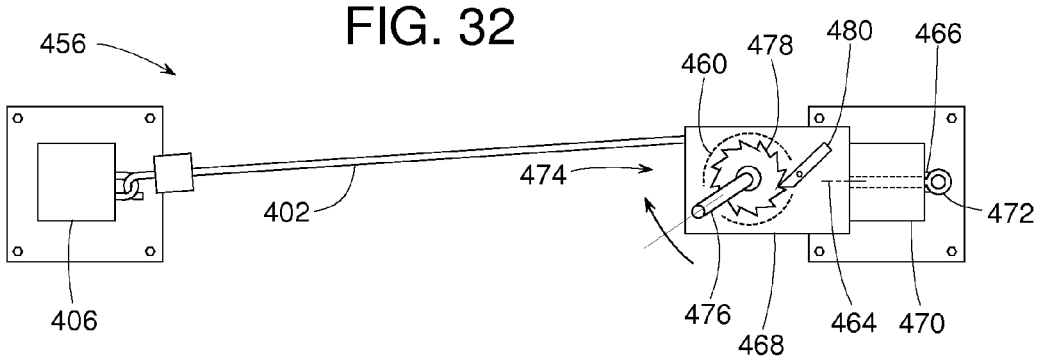
FIG. 32 is a top view showing the barrier of FIG. 30 being tightened.

After being extended between support members 470 and 406, barrier 402 can be tightened using a manual crank mechanism 474, as shown in FIG. 32. In this case, crank mechanism 474 comprises a crank 476 driving a ratchet 478 and pawl 480 assembly. Crank 476, ratchet 478, and drum 460 can be rotated as a unit about first axis 462 relative to frame 468. In addition to being able to tighten barrier 402 when extended, crank mechanism 474 can also be used for retracting barrier 402 onto drum 460. In addition or as an alternative to crank mechanism 474, drum 460 could be spring-loaded as shown in FIGS. 24 and 27.

Figure 34:
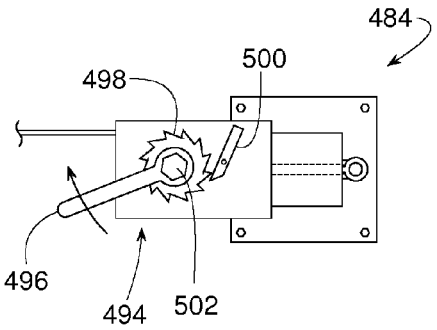
FIG. 34 is a top view of the barrier system of FIG. 33 being tightened.
Figure 35:
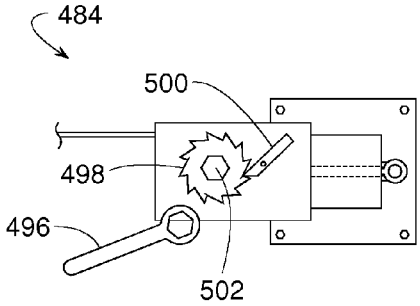
FIG. 35 is a top view similar to FIG. 34 but showing the system already tightened.
Figure 33:
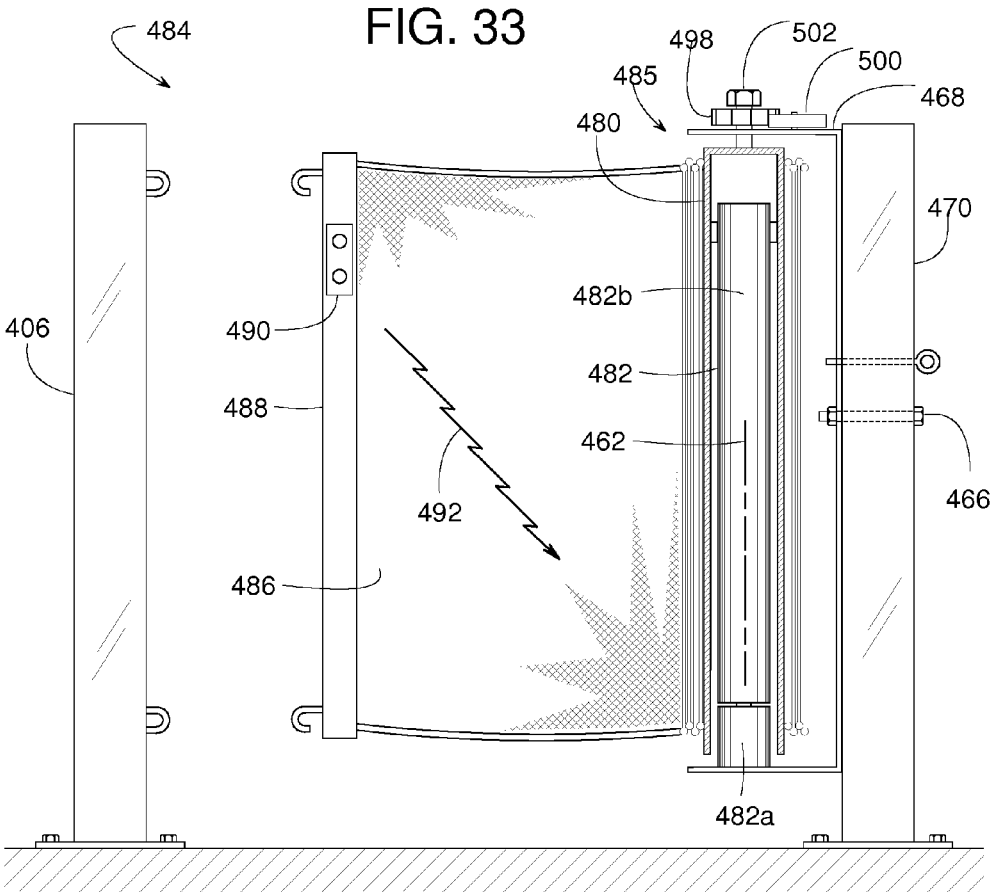
FIG. 33 is a cross-sectional front view of an example motorized barrier system.

A take-up drum could also be powered by a tubular motor 482 (e.g., such as those produced by SIMU US, Inc. of Boca Raton, Fla.) as is the case with a barrier system 484 of FIGS. 33-35. A lower stationary portion 482*a* of motor 482 is fastened to frame 468, which in turn is pivotally coupled to support member 470 via bolt 466. An upper rotating portion 482*b* of motor 482 is attached to a rotating drum 480 of a take-up member 485 so that portion 482*b* and drum 480 rotate as a unit about first axis 462 when motor 482 is energized. Depending on the rotational direction of motor 482, drum 480 either takes in or pays out a flexible barrier 486 attached to drum 480.

To enable a single user to control the actuation of motor 482 while the user manually carries a distal end 488 of barrier 486 between support members 470 and 406, the user has access to a motor controller 490 attached to the barrier's distal end 488. Controller 490 includes one or more switches to command motor 482 to run forward, run in reverse, or stop. Communication between controller 490 and motor 482 can be by way of wires running along the length of barrier 486 or via a wireless communication link 492 (e.g., radio signals).

After being extended between support members 406 and 470, barrier 486 can be tightened using a manual crank mechanism 494, as shown in FIG. 34. In this case, mechanism 494 comprises a wrench 496 driving a ratchet 498 and pawl 500 assembly. When wrench 496 engages a mating nut 502 on ratchet 498, wrench 496, nut 502, ratchet 498, and drum 480 can be manually rotated as a unit about first axis 462 relative to frame 468. Once barrier 486 is tightened, pawl 500 engages ratchet 498 to hold drum 480 in place, and wrench 496 can be removed, as shown in FIG. 35.

Figure 36:
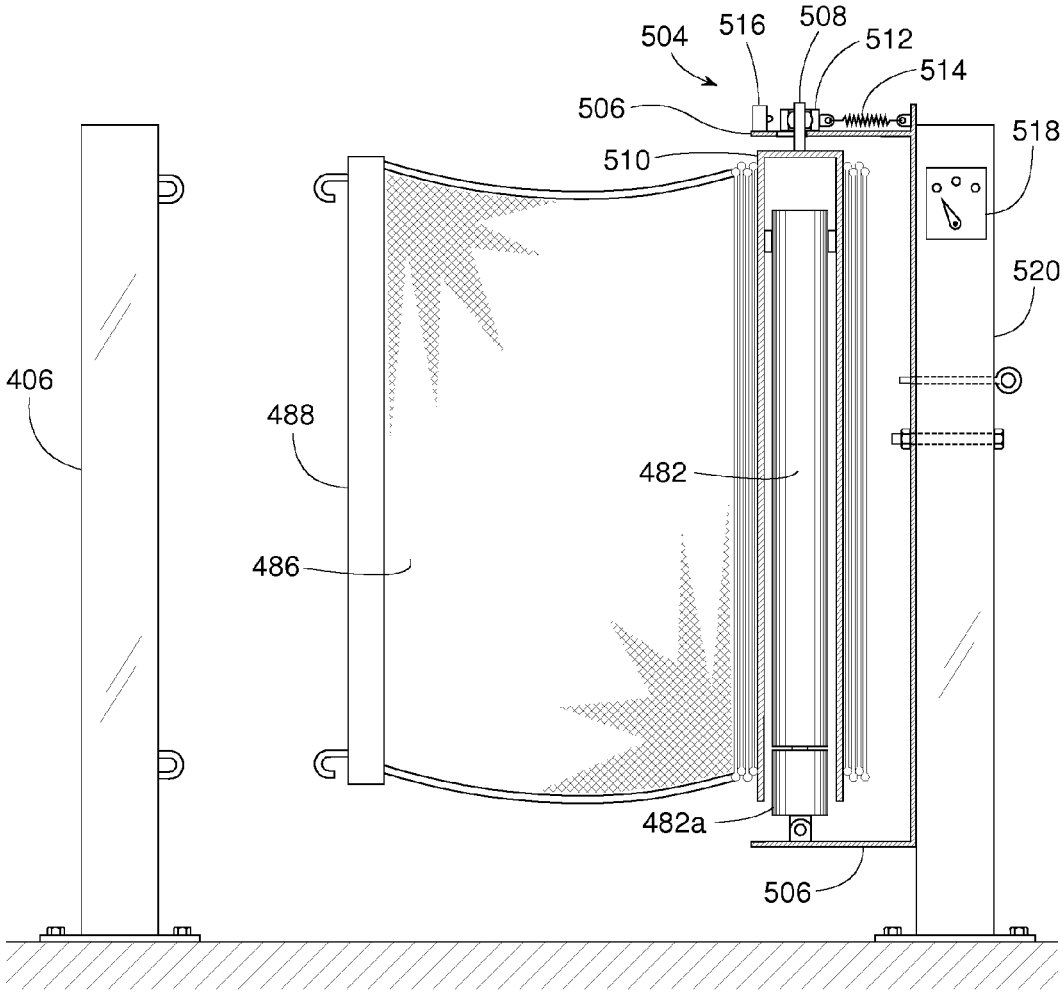
FIG. 36 is a front cross-sectional view of an example barrier system in a de-activated position.
Figure 37:
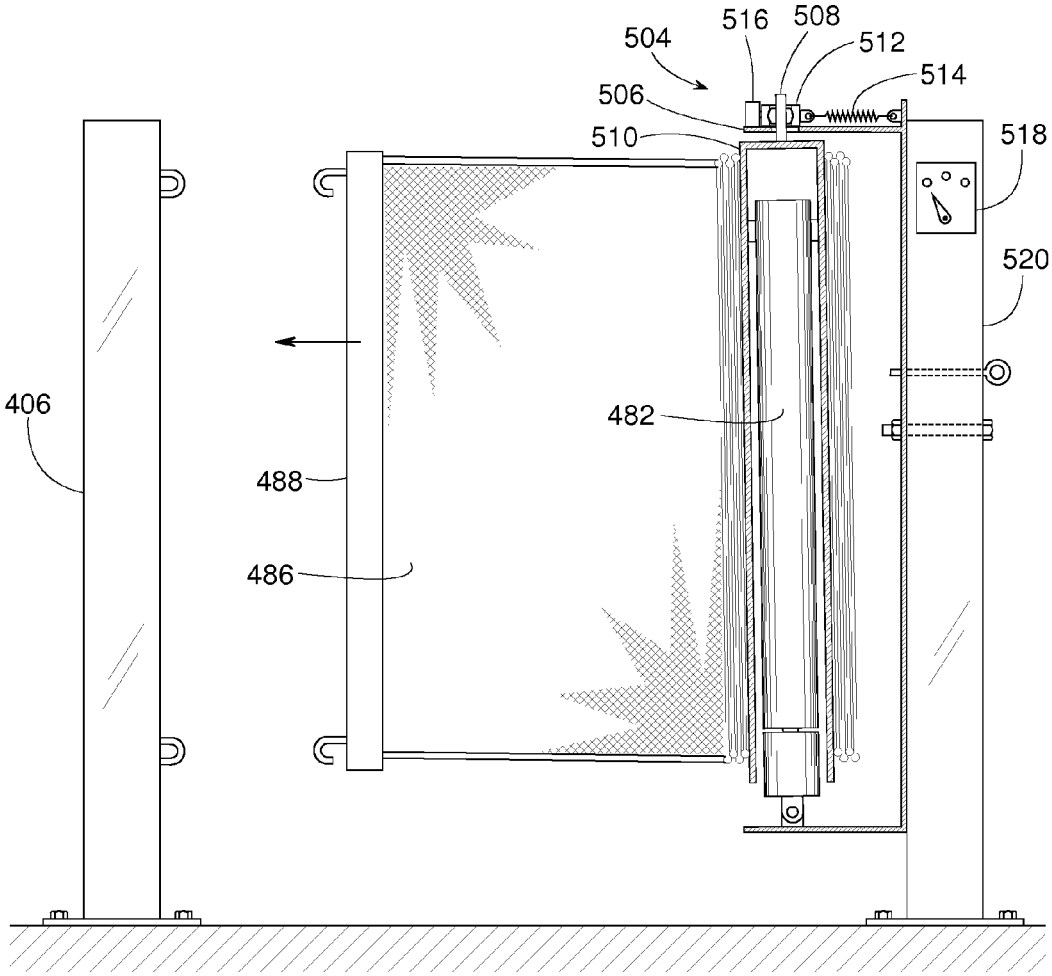
FIG. 37 is a front cross-sectional view similar to FIG. 36 but showing the system in the activated position.

As an alternative to mounting controller 490 at the distal end of barrier 486, a different type of control mechanism 504 can be installed as shown in FIGS. 36 and 37. In this case, lower stationary portion 482*a* of motor 482 is pivotally coupled to a frame 506. An upper end 508 of a drum 510 is supported by a bearing 512 that can translate relative to frame 506. Bearing 512 and upper end 508 can move between a stop position (FIG. 36) and a run position (FIG. 37). A spring 514 urges bearing 512 and upper end 508 toward the stop position where motor 482 is de-energized. Manually tugging on distal end 488 of barrier 486 overcomes spring 514 and forces bearing 512 to the run position of FIG. 37 where bearing 512 engages a limit switch 516 that energizes motor 482. Upon energizing motor 482, drum 510 pays out or draws in barrier 486 depending on the extend-retract-off position of a selector switch 518.

When switch 518 is in the EXTEND-position, manually tugging on distal end 488 of barrier 486 energizes motor 482 to automatically pay out barrier 486. At this time, the user can readily carry distal end 488 of barrier 486 over to second support member 406. When the user stops tugging on distal end 486, spring 514 moves bearing 512 away from limit switch 516 to automatically stop the rotation of drum 510.

To retract barrier 486, switch 518 is turned to the OFF-position, and the user tugs on distal end 488 of barrier 486, thereby forcing bearing 512 against limit switch 516. This energizes motor 482 to draw in barrier 486 onto drum 510. While keeping bearing 512 up against limit switch 516, the user can readily carry distal end 488 of barrier 486 toward a first support member 520. When distal end 488 and the user reach first support member 520, the user turns switch 518 to its OFF-position so that barrier 486 can be stored in its retracted position.

In another example, shown in FIGS. 38-58, a barrier system 600 includes a gear assembly 602 that facilitates rapidly deploying a flexible barrier 604, exerting high torque for tightening barrier 604, maintaining high tension in barrier 604 when in use, and/or rapidly retracting barrier 604 for storage. Other optional features include, selective right-hand/left-hand configurations (e.g., compare FIGS. 38 and 54), an electric switch 606 that can be added to indicate whether barrier system 600 is in use, an intermediate coupling 608 (FIG. 55) for creating an extra long barrier system 610, and removable vehicle-mounted posts 612 (FIGS. 56-58) for certain loading dock applications.

Barrier system 600 comprises a barrier take-up member 614 (drum, shaft, etc.) that a set of bearings 616 rotatably supports within a housing 618. A bolt 620 pivotally connects housing 618 to a first support member 622. One end of barrier 604 is fastened to take-up member 614 and an opposite distal end 624 of barrier 604 is suitable for connection to a second support member 626. Gear assembly 602 is connected to drive the rotation of take-up member 614, as will be explained later in greater detail. Gear assembly 602 is connected to take-up member 614, which in turn is coupled to first support member 622, thus gear assembly 602 is also coupled to first support member 622.

Figure 31:
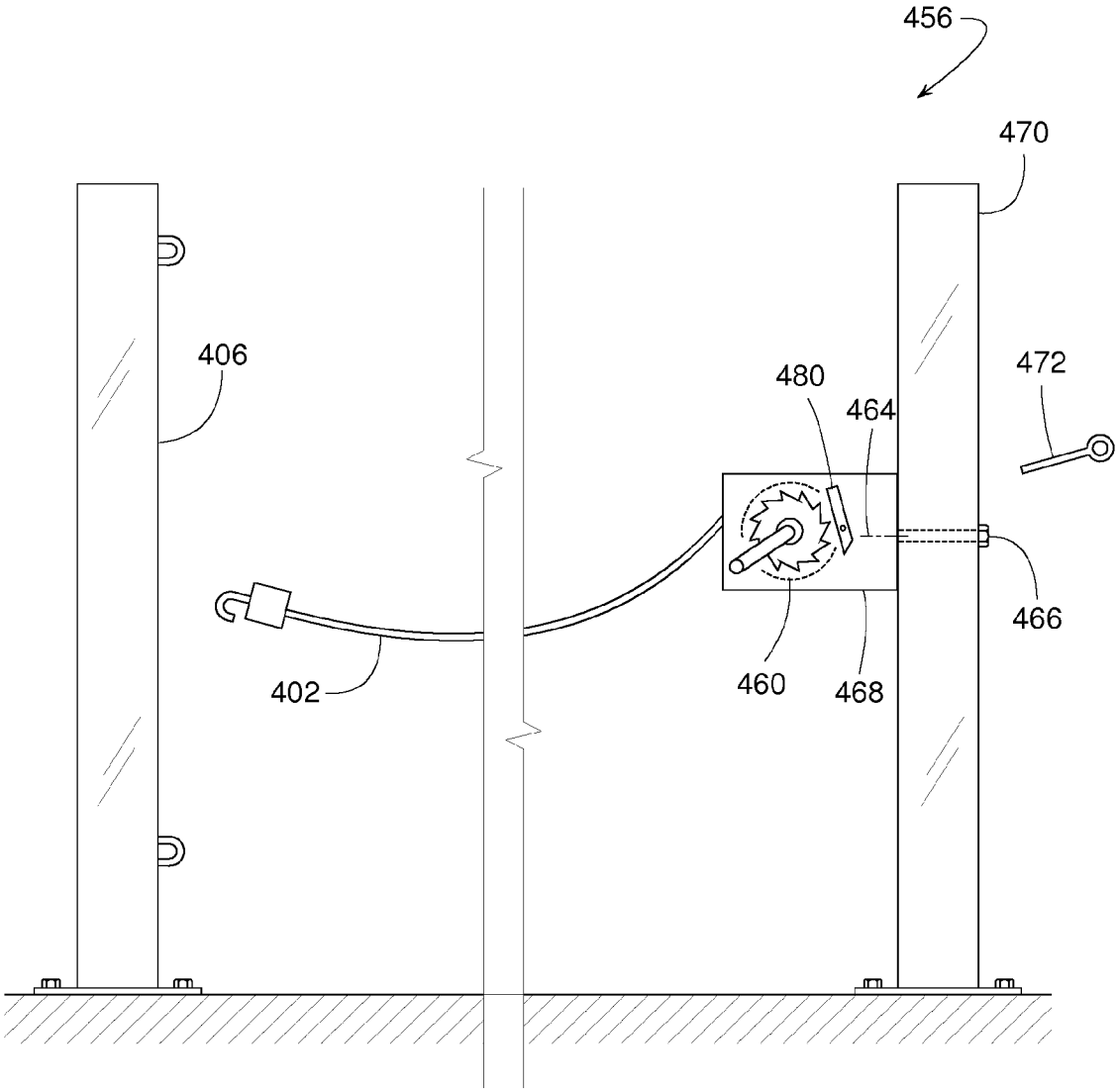
FIG. 31 is a front view of the barrier system of FIG. 30 but showing the barrier being moved between its extended and retracted positions.
Figure 41:
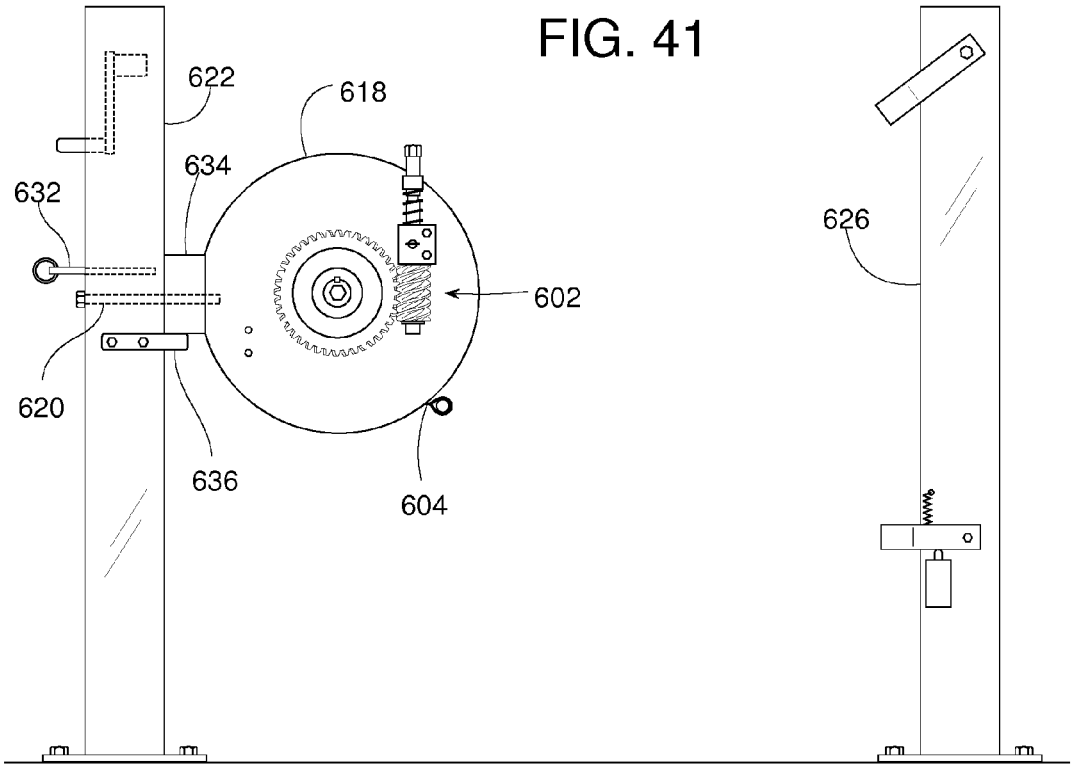
FIG. 41 is a front view of FIG. 40.

In a manner similar to barrier system 456 of FIGS. 30-32, take-up member 614 of barrier system 600 can not only rotate about its longitudinal axis 628 (which is generally vertical when take-up member 614 is upright) but can also tilt about a generally horizontal axis 630. Take-up member 614 rotating about axis 628 either retracts or pays out barrier 604, depending on the direction of rotation. Take-up member 614 tilting about axis 630 enables take-up member 614 to be in a generally upright position (FIG. 39) or in a laid-over position (FIG. 41). The upright position can be used for storage or guarding operation, and the laid-over position facilitates deploying or retracting barrier 604.

Figure 38:
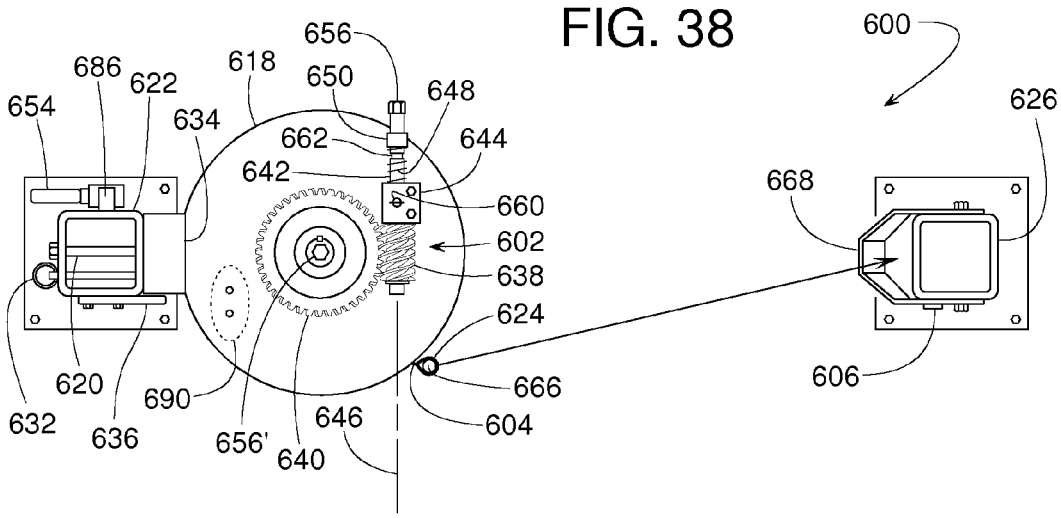
FIG. 38 is a top view of an example barrier system with its barrier retracted.
Figure 39:
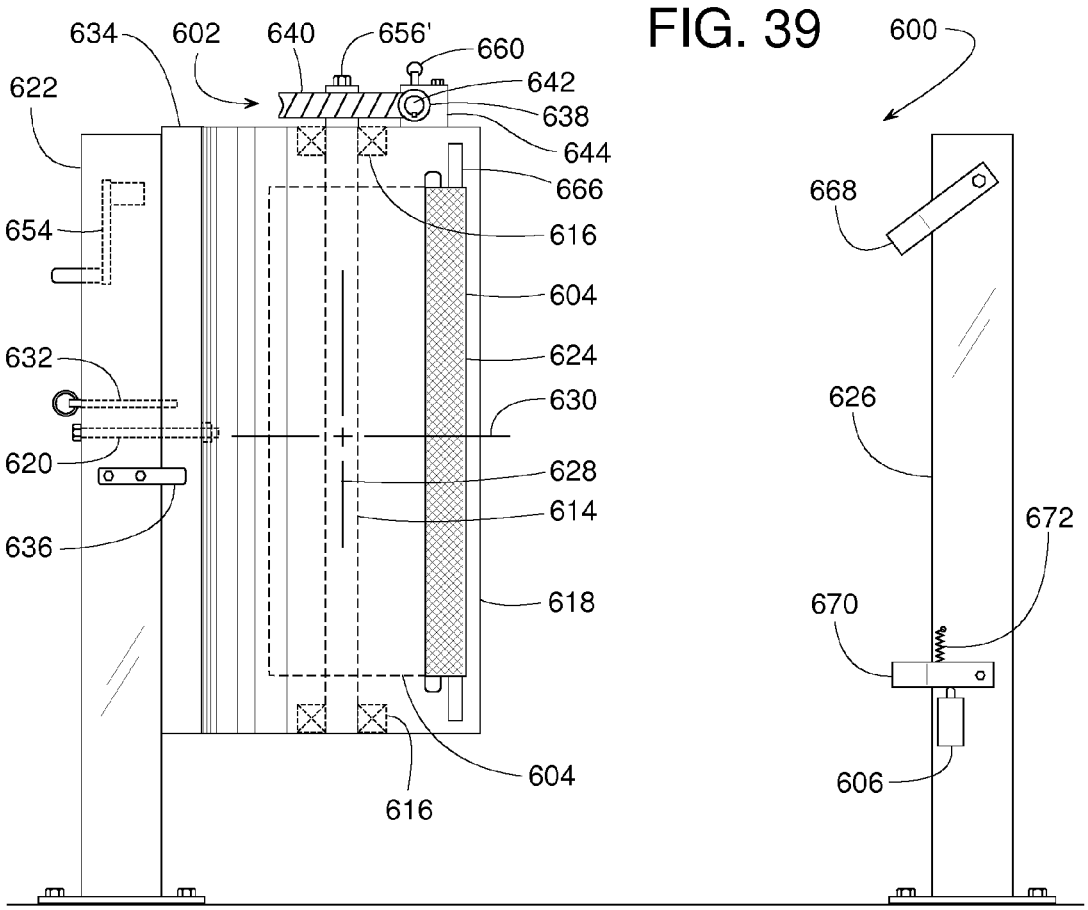
FIG. 39 is a front view of FIG. 38.

A sequence of operation might begin with barrier system 600 in its stored position of FIGS. 38 and 39. In this position, take-up member 614 is generally upright with most of barrier 604 wrapped around it. To help hold this upright position, a latch 632 (e.g., a spring loaded pin) extends through first support member 622 and protrudes into a hole in a frame member 634 of housing 618. With barrier system 600 in its stored position, the space between supports members 622 and 626 is generally open and unobstructed by barrier 604.

Figure 40:
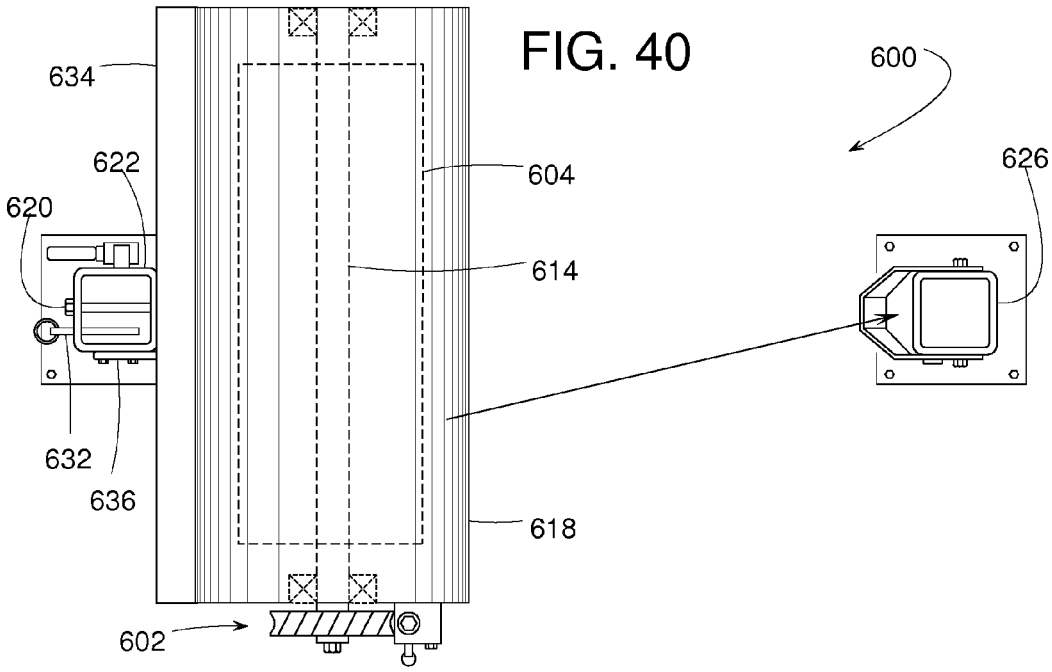
FIG. 40 is a top view of an example barrier system with its take-up member tilted sideways.

Before extending barrier 604 to block off the area between supports members 622 and 626, latch 632 is manually retracted, as shown in FIGS. 40 and 41. Bolt 620 and retracted latch 632 allow housing 618 and take-up member 614 to be tilted until frame member 634 engages a stop 636. Stop 636 can be a bar bolted at a select location on first support member 622. Take-up member 614 in its laid-over position makes it easier to extend and especially retract barrier 604 without barrier 604 tending to crawl or work its way down to the lower end of a vertical take-up member.

Figure 42:
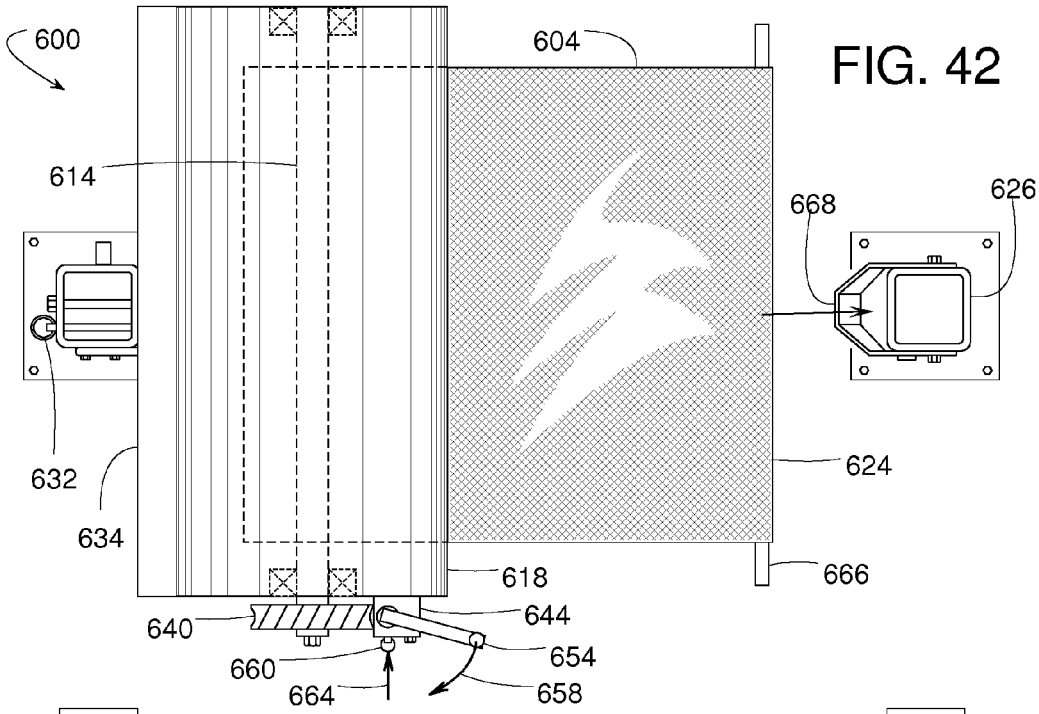
FIG. 42 is a top view of an example barrier system with its barrier partially extended.
Figure 43:
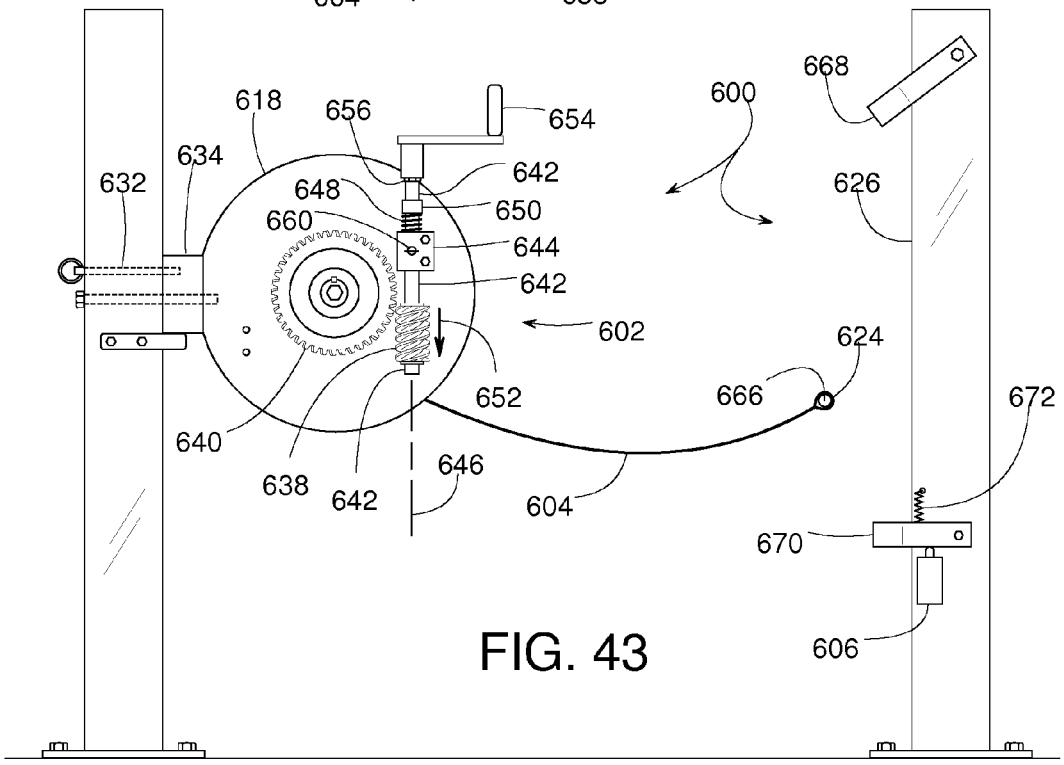
FIG. 43 is a front view of FIG. 42.

To extend barrier 604, as shown in FIGS. 42 and 43, first latch 632 is inserted in another hole in frame member 634 to help hold take-up member 614 generally horizontal. Gear assembly 602 is then disengaged so that take-up member 614 can spin freely. This allows barrier 604 to be readily extended by simply tugging on the barrier's distal end 624 and pulling barrier 604 out from within housing 618.

Disengaging a gear assembly from a take-up member can be accomplished in various ways depending on the particular design of the gear assembly. For the illustrated example, gear assembly 602 comprises a drive gear in the form of a worm 638 (similar to a screw) meshing with a driven gear in the form of a worm gear 640 (similar to a spur gear). The gear reduction for this particular example is about 20:1, thus worm gear 640 makes one revolution for each twenty revolutions of worm 638. Such a high ratio provides multiple benefits, which will be explained later. It should be noted that the 20:1 gear or turning ratio is only provided as an example, and many other higher or lower ratios would be likewise equivalent design choices.

Worm gear 640 is fastened to take-up member 614 such that the two rotate as a unit. Worm 638 is fastened to a shaft 642 that can rotate within a bracket 644 attached to housing 618. Shaft 642 can also slide axially along its rotational axis 646 so that worm 638 can be axially moved between an engaged position (FIG. 38) and a disengaged position (FIG. 43). A compression spring 648 between bracket 644 and a collar 650 on shaft 642 urges shaft 642 and worm 638 to the engaged position of FIG. 38. Worm 638 in the engaged position places gear assembly 602 in the engaged mode.

To move worm 638 to the disengaged position of FIG. 43, shaft 642 and the attached worm 638 can be manually pushed in direction 652. To assist this movement, a manual crank 654 or wrench can be placed on, for example, a hexagon head 656 (FIG. 38) of shaft 642 and rotated in direction 658 while holding worm gear 640 stationary. The interaction between rotating worm 638 and stationary worm gear 640 will force worm 638 and shaft 642 in direction 652 and compress spring 648 in the process.

To hold worm 638 is in the disengaged position of FIG. 43, bracket 644 includes a catch 660, such as a spring-loaded retractable pin. In this example, catch 660 includes a pin end that under spring force pushes against the outer cylindrical surface of shaft 642. Shaft 642 has a circumferential groove 662 (FIG. 38) that becomes aligned with the pin end when shaft 642 is moved to the position of FIG. 43. When groove 662 and the pin end of catch 660 are aligned, the pin end, under spring force, drops into groove 662 to hold shaft 642 in the extended position of FIG. 43. The movement of the pin end into groove 662 is represented by arrow 664 of FIG. 42. It should be noted that catch 660 extends farther out from bracket 644 in FIG. 39 than in FIG. 42 because in FIG. 42 the pin end of catch 660 has dropped into groove 662, but in FIG. 39, the pin end is pushing against the major outer diameter of shaft 642 in a section outside of groove 662.

Figure 44:
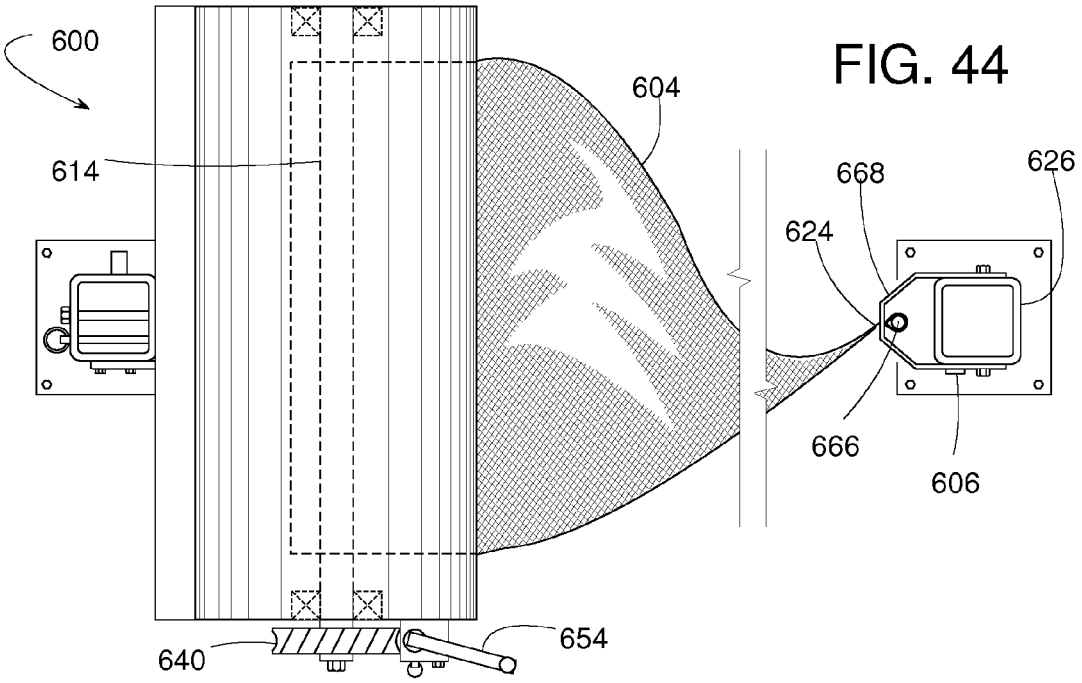
FIG. 44 is a top view of an example barrier system with its take-up member laid over and its barrier extending slack between two support members.
Figure 45:
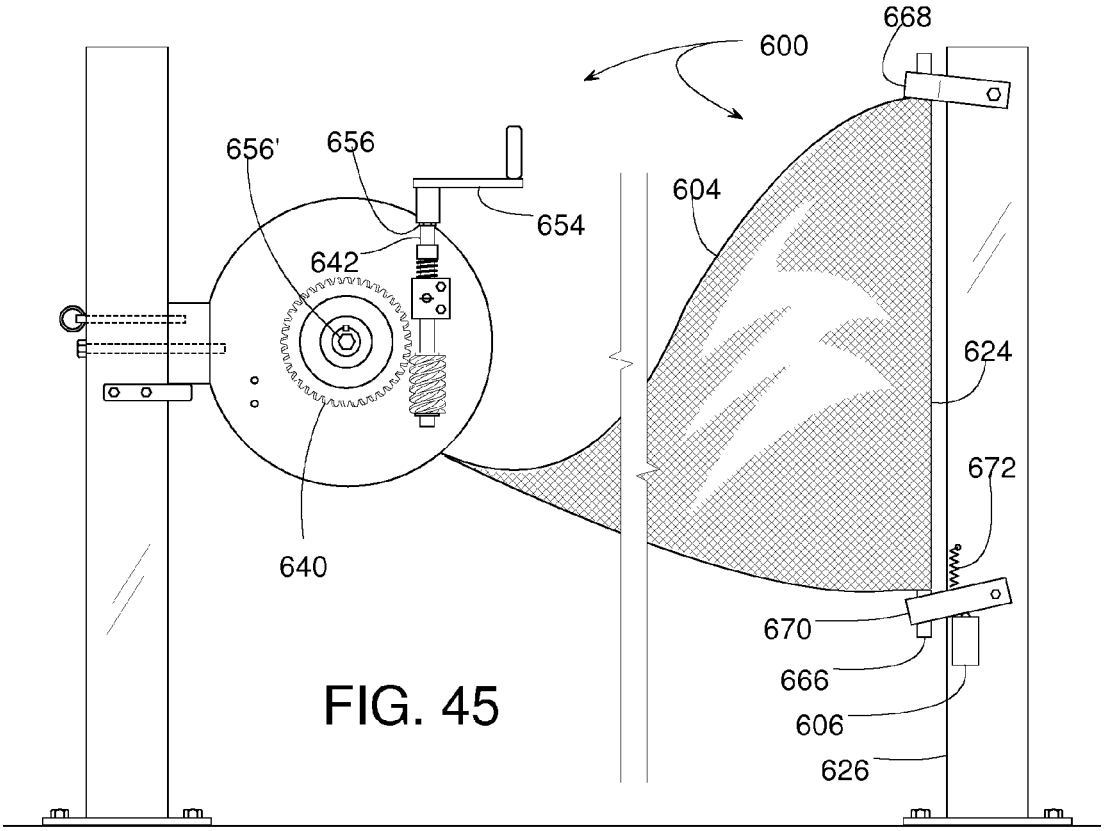
FIG. 45 is a front view of FIG. 44.

With worm 638 disengaged from worm gear 640, as shown in FIG. 43, worm gear 640 and take-up member 614 can turn freely, thus barrier 604 can be readily extended by simply manually gripping the barrier's distal end 624 and pulling barrier 604 out from within housing 618. A rod 666 at distal end 624 can then be inserted, as shown in FIGS. 44 and 45, within two harnesses 668 and 670 that are pivotally attached to second support member 626. Although a spring 672 biases harness 670 upward, the weight of the barrier's distal end 624 pushes harness 670 down to trip electric switch 606. A signal from switch 606 can then be used for a safety interlock and/or to operate a light or alarm that indicates the operational status of barrier system 600.

Figure 46:
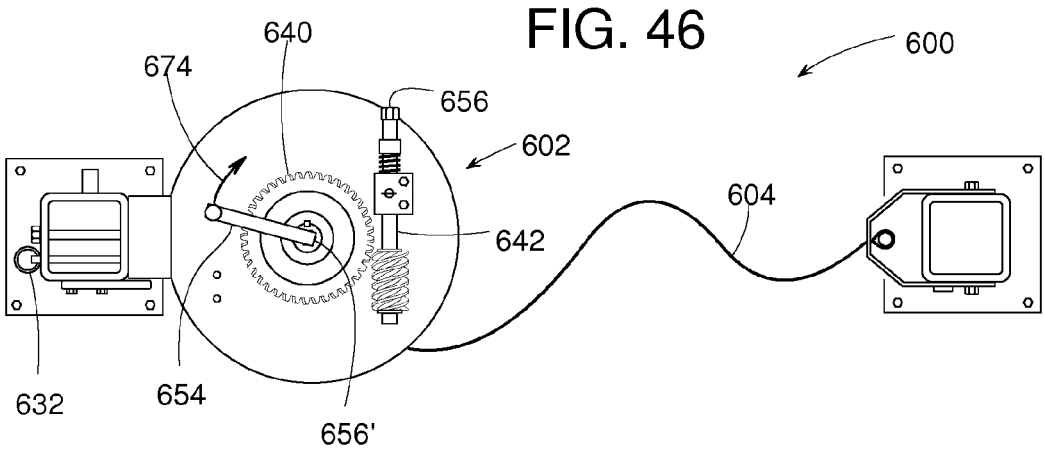
FIG. 46 is a top view of an example barrier system with its take-up member upright and its barrier extending slack between two support members.
Figure 47:
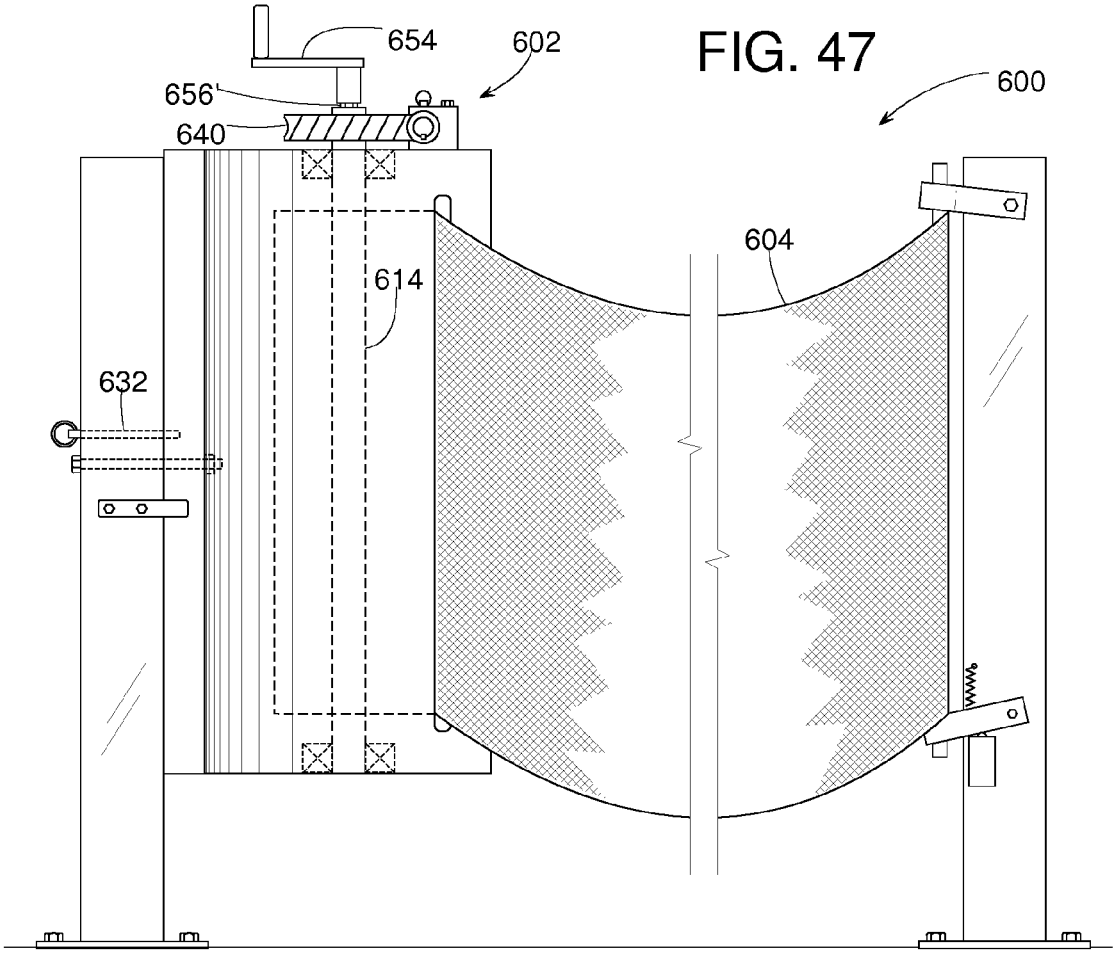
FIG. 47 is a front view of FIG. 46.

At about the same time that distal end 624 is attached to second support member 626, take-up member 614 can be returned to its upright position of FIGS. 46 and 47. To right take-up member 614, latch 632 is temporarily retracted.

Once take-up member 614 is upright, crank 654 can be moved from end 656 of shaft 642 to a similar hexagonal end 656' that is fixed relative to worm gear 640 and take-up member 614. Crank 654 can then be rotated in direction 674 to draw in and take up much of the slack from barrier 604. Although crank 654 turning worm gear 640 and take-up member 614 directly (1:1 turning ratio) does not provide the 20:1 mechanical advantage of gear assembly 602 operating in an engaged mode, the 1:1 ratio does provide a way of quickly taking up most of the slack in barrier 604.

Figure 48:
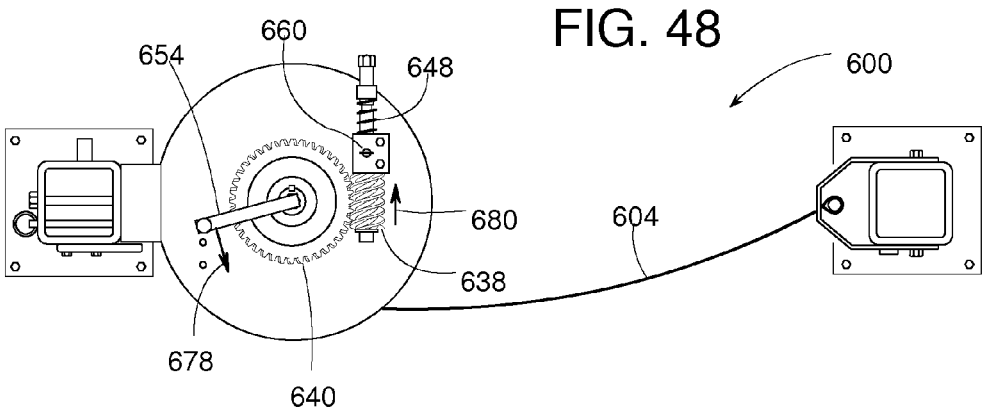
FIG. 48 is a top view similar to FIG. 46 but with its barrier partially tightened.
Figure 49:
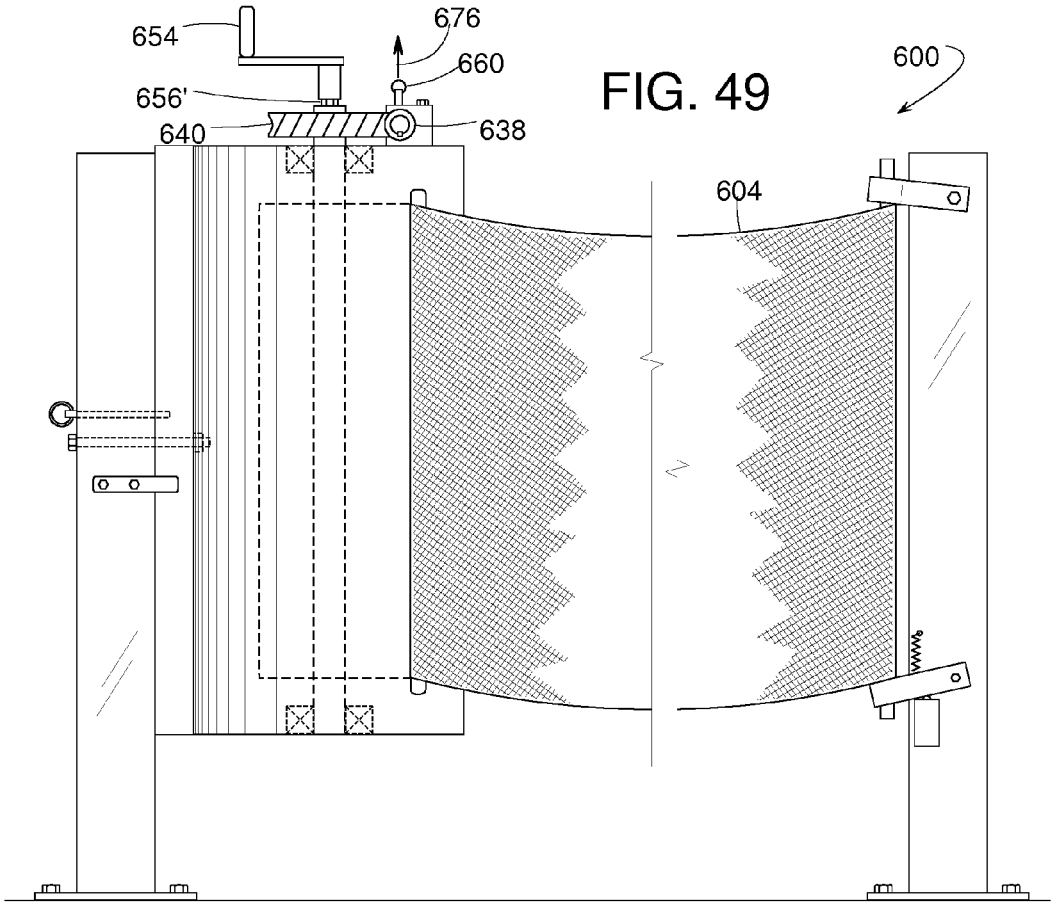
FIG. 49 is a front view of FIG. 48.

After much of the slack is taken up, as shown in FIGS. 48 and 49, catch 660 can be retracted in the direction of arrow 676 to remove the pin end of catch 660 out from within groove 662, and at about the same time crank 654 can be turned slightly in direction 678. Spring 648 and the slight rotation of worm gear 640 in direction 678 will move worm 638 in direction 680 from the worm's disengaged position of FIG. 46 to its engaged position of FIG. 48.

Figure 50:
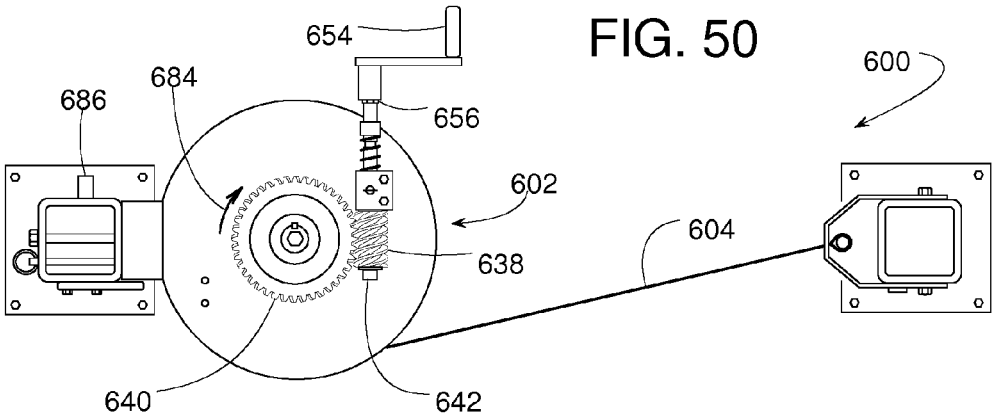
FIG. 50 is a top view similar to FIG. 46 but with its barrier fully tightened.
Figure 51:
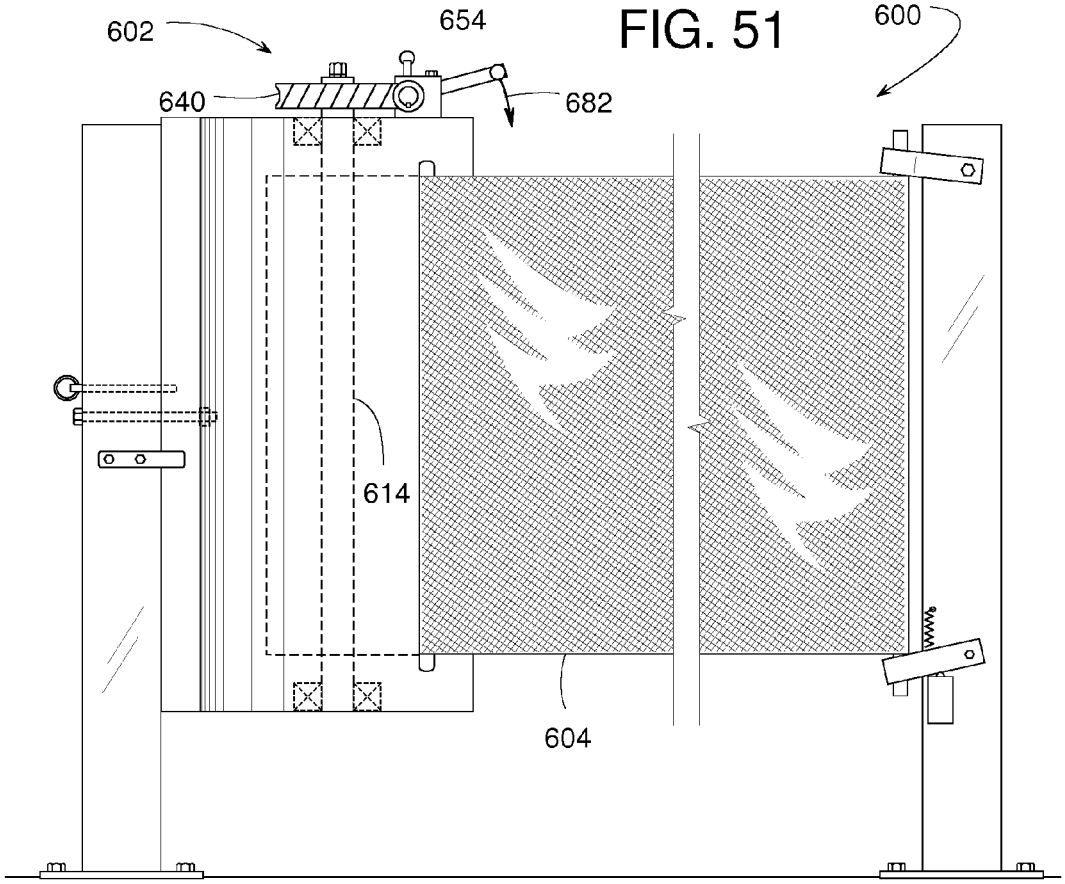
FIG. 51 is a front view of FIG. 50.
Figure 52:
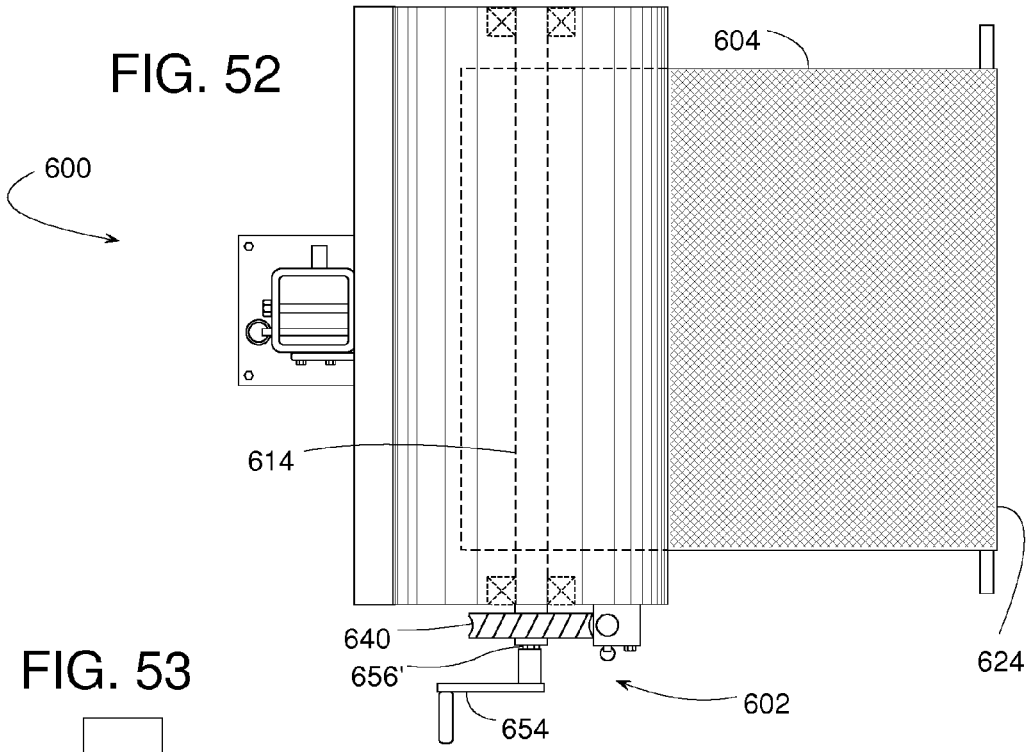
FIG. 52 is a top view of an example barrier system with its barrier being wound up.

To further tighten barrier 604, crank 654 can be moved from worm gear 640 back onto end 656 to drive worm 638, as shown in FIGS. 50 and 51. With gear assembly 602 now in the engaged mode, turning crank 654 in direction 682 turns worm gear 640 in direction 684 with a high turning ratio (e.g., 20:1). For this example, in the engaged mode, every twenty revolutions of crank 654, shaft 642, and worm 638 rotates worm gear 640 and take-up member 614 one revolution. The high gear ratio provides two benefits. First, the manual tightening torque applied to crank 654 is greatly multiplied at worm gear 640, and the resulting high torque is transmitted to take-up member 614 to produce high tension in barrier 604. Second, the high gear ratio of a worm drive prevents the tension in barrier 604 from backspinning take-up member 614 and worm gear 640, thus the worm drive serves as a self-locking mechanism after barrier 604 is tightened. With such a self-locking mechanism, after barrier 604 is tightened, crank 654 can be removed from gear assembly 602 and stored using a crank holder 686 (FIG. 38) on first support member 622.

Figure 53:
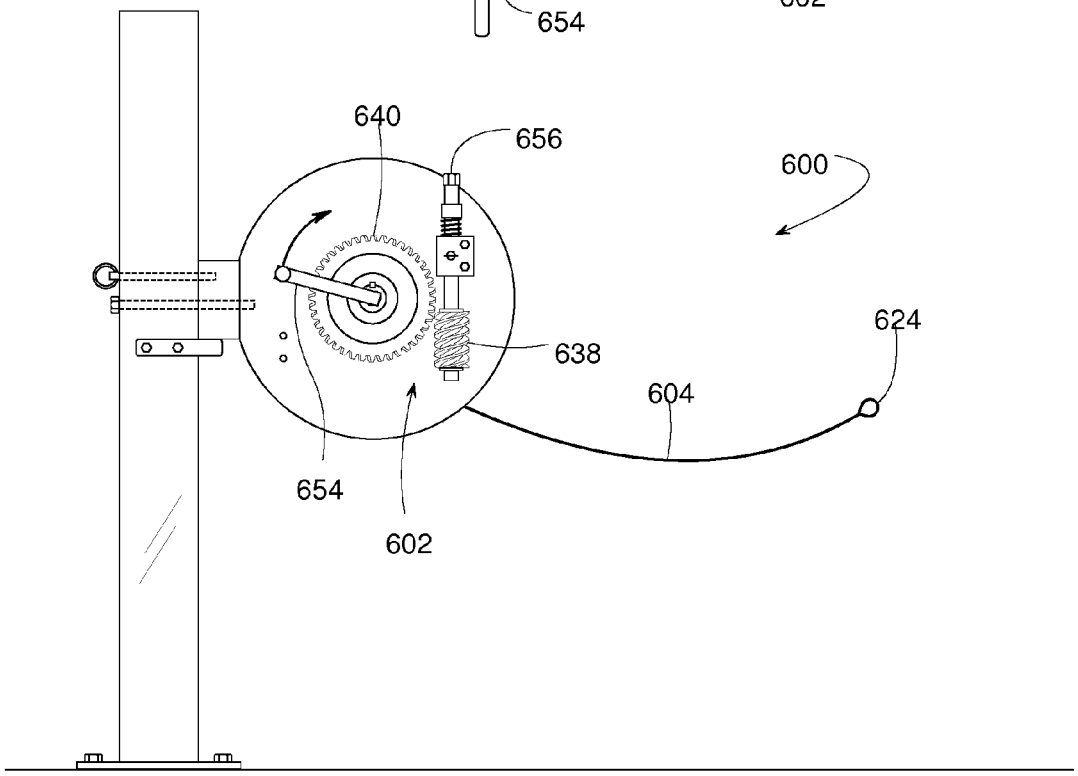
FIG. 53 is a front view of FIG. 52.

To retract and store barrier 604, a user reverses the steps of FIGS. 44-51, thus the barrier retracting sequence is the reversal of steps illustrated in FIGS. 50 and 51, FIGS. 48 and 49, FIGS. 46 and 47, and FIGS. 44 and 45. Once distal end 624 is separated from second support member 626 with worm 638 disengaged, as shown in FIG. 53, crank 654 can be placed on end 656' to rapidly crank worm gear 640 and take-up member 614 in a 1:1 rotational speed ratio. As an alternative to crank 654, an electric drill with a hex socket on end 656' can drive the rotation of worm gear 640 and take-up member 614 to rapidly retract barrier 604. As yet another alternative, gear assembly 602 can be moved to the engaged mode (worm 638 engaging worm gear 640), and an electric drill with a hex socket on end 656 can drive the rotation of worm 638 to rapidly retract barrier 604.

Figure 54:
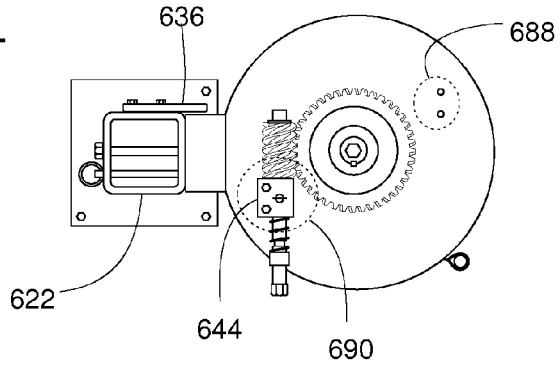
FIG. 54 is a top view of the support member of FIG. 38 but shown in another configuration.

First support member 622 shown in FIG. 54 is the same as first support member 622 of FIG. 38, only reconfigured. For operating convenience, flexibility and user preference, bracket 644 can be selectively mounted at either of two choice locations 688 or 690. To enable take-up member to be tilted in either direction, stop 636 can be mounted at a first location, as shown in FIG. 38 or a second location, as shown in FIG. 54. In FIG. 54, crank holder 686 has been omitted to more clearly show the second mounting location of stop 636.

Figure 55:
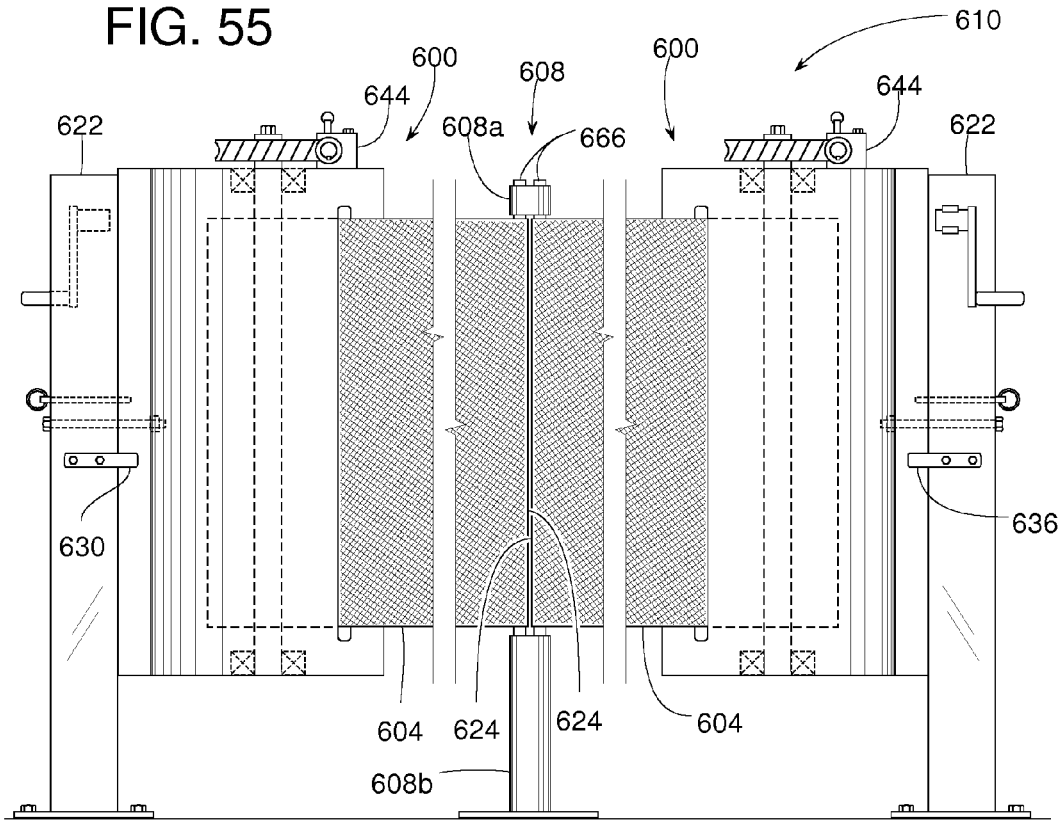
FIG. 55 is a front view of two example retractable barriers coupled to each other at an intermediate point between two support members.

To provide an extra long barrier without the need for a fixed central support post, the distal ends 624 of two barriers 604 from two separate first support members 622 can be joined to each other by way of intermediate coupling 608. In this example, first support member 622 on the left side of FIG. 55 is the same as first support member 622 of FIG. 38, and first support member 622 on the right side of FIG. 55 is configured as shown in FIG. 54. Coupling 608 can be any structure that joins two distal ends 624 of two barriers 604 that are retractable in generally opposite directions. In the illustrated example, coupling 608 comprises an upper tube 608*a* and a lower tube 608*b* that encircle and capture the upper and lower ends of rods 666. An alternative to tubes 608*a* and 608*b* would be looped clips or hooks temporarily or permanently attached to the ends of rods 666, wherein a clip on one rod 666 could reach over and latch onto an adjacent rod 666.

Figure 56:
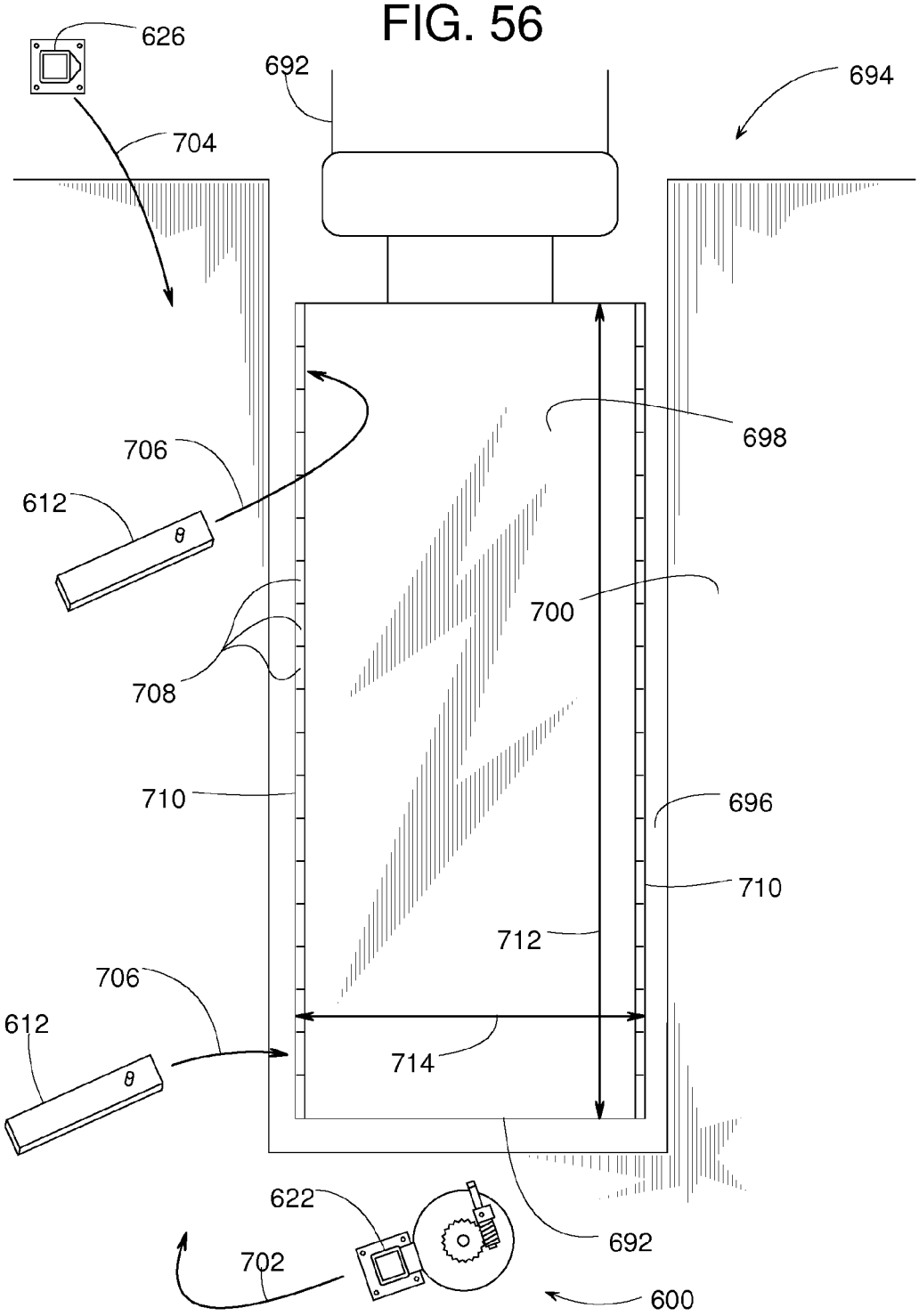
FIG. 56 is a top view of an example barrier system method at a loading dock.
Figure 57:
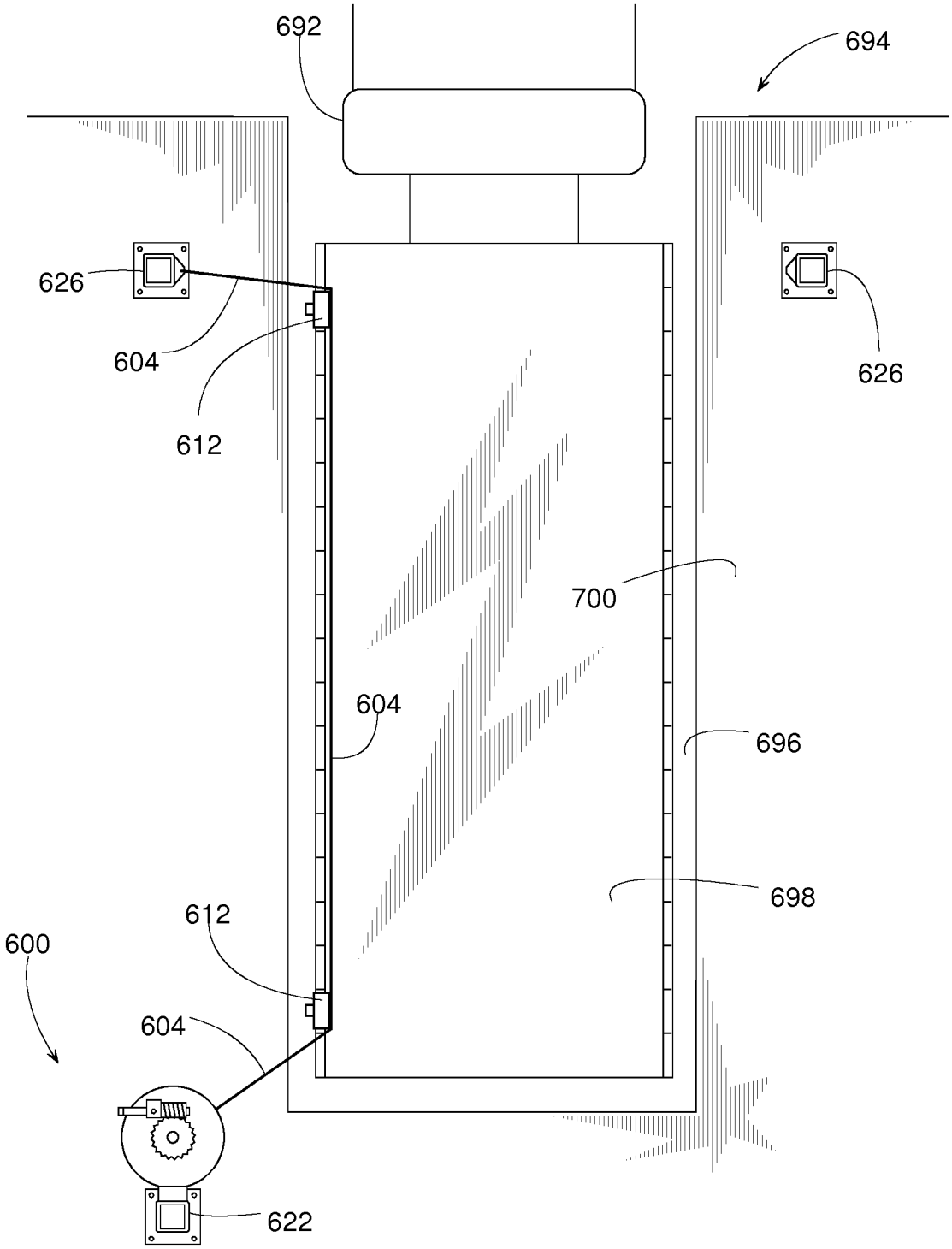
FIG. 57 is a top view similar to FIG. 56 but showing the barrier guarding one side of the vehicle bed.
Figure 58:
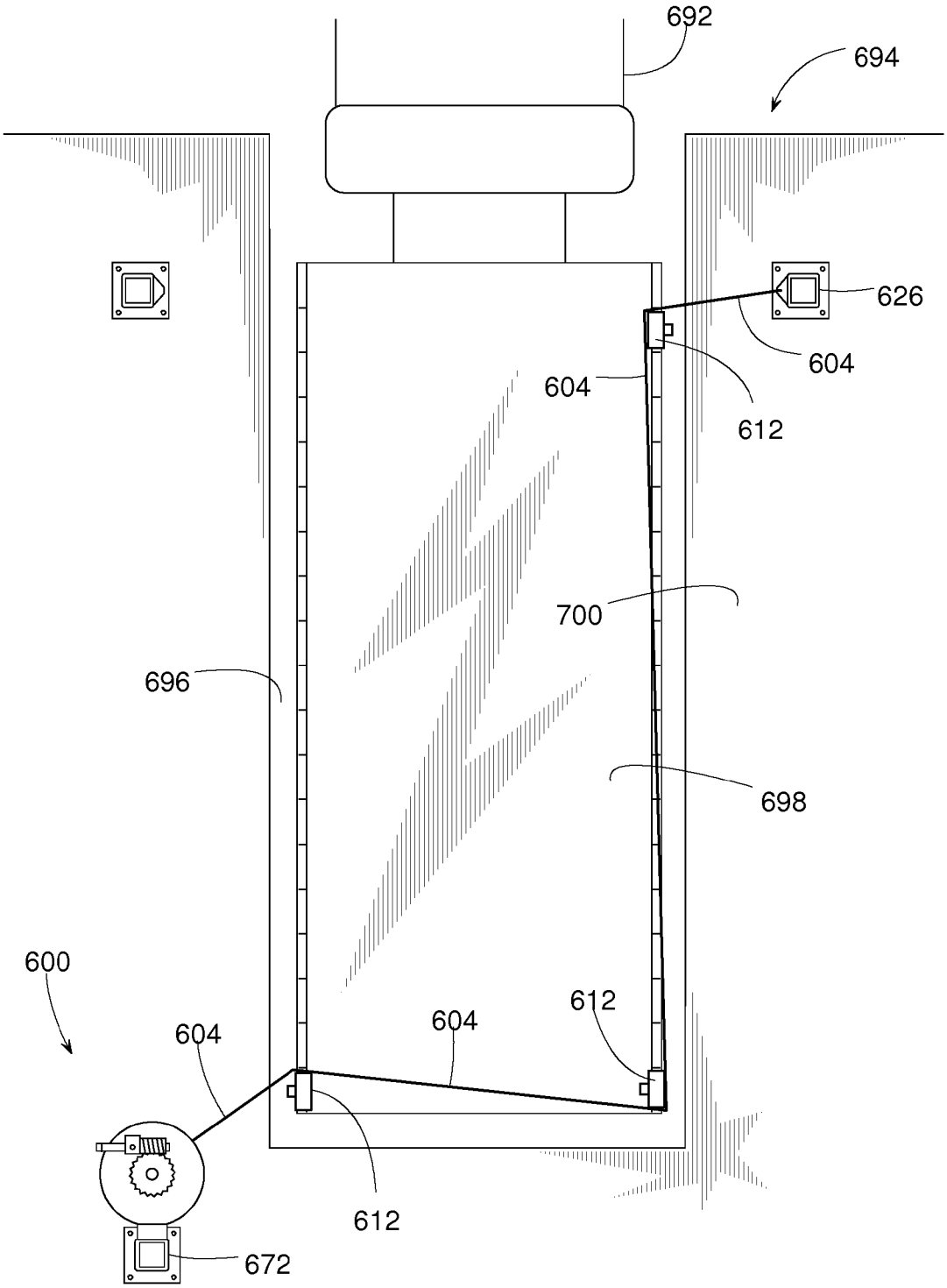
FIG. 58 is a top view similar to FIG. 57 but showing the barrier system set up to guard one side plus the back end of the vehicle bed.

Barrier system 600 may be advantageously used for guarding a vehicle 692 such as an open bed truck or trailer at a pit-style side loading dock 694, as shown in FIGS. 56-58. In this example, vehicle 692 backs into a pit 696 of dock 694 so that the floor of vehicle's bed 698 is generally flush with an elevated platform 700 of dock 694. To provide guarding that helps prevent someone from accidentally falling into pit 696, the following method can be implemented: mounting 702 a first support member 622 to loading dock 694; mounting 704 a second support member 626 to loading dock 694 at a location spaced apart from first support member 622; installing 706 one or more removable posts 612 to vehicle 692; and extending (as shown in FIGS. 57 and 58) retractable, flexible barrier 604 from first support member 622 to second support member 626 such that barrier 604 engages at least one removable post 612.

To temporarily attach post 612 to vehicle 692, the lower end of post 612 can be sized to fit in any of a series of slots 708 in a conventional bed rail 710 of vehicle 692. By installing posts 612 at certain slots 708 and extending barrier 604 along various routes, barrier 604 can extend along a length 712 and/or a width 714 of bed 698.

In some examples, a retractable rollup barrier is provided with substantial impact resistance by having the reactive force of the impact transfer directly between the barrier's retractable panel and its vertical support members without having to rely on the strength of the panel's take-up roller or the strength of the roller's anti-rotation mechanism.

In some examples, a retractable rollup barrier includes a stop member that is carried by the rollup panel itself.

In some examples, the stop member is an elongate member, such as a pipe, rod or bar that broadly distributes an impact reactive force over the height of the rollup panel.

In some examples, the stop member comprises multiple separate members on the same vertical line. The separate members could be a series of pipes, rods, or bars that work together to broadly distribute an impact reactive force over the height of a retractable panel.

In some examples, a retractable rollup barrier can be set for various doorway widths by simply repositioning a stop member's location on the rollup panel.

In some examples, the extent to which a rollup panel can extend out from within a housing is limited by a thicker section of the panel being unable to fit through a narrower slot in one of the barrier's support members.

In some examples, a retractable panel includes reinforcing straps that greatly increase the panel's strength.

In some examples, the reinforcing straps of the retractable panel can be of a different color than the rest of the panel so that the panel is clearly visible when in use.

In some examples, the panel includes a large warning label that is visible from a distance so that people in the area can see that a drop-off hazard exists even though a closed dock door may disguise the danger.

In some examples, the rollup panel does not reach its full extension from within its housing until the panel experiences an impact. This feature allows a distal end of the panel to be readily hooked or unhooked from an anchored support member without the panel having to be pulled tightly against a hard stop to do so.

In some examples, a retractable barrier straddles a dock leveler.

In some examples, two anchor support members of a retractable barrier can serve as bollard-like members for protecting the lateral edges of a door from damage.

In some examples, a distal end of a retractable panel can retract and stow within a pocket of a support member housing to protect the distal end from damage and avoid interfering with traffic when the retractable barrier is not in use.

In some examples, a retractable safety barrier comprises a flexible strap that is supported by two take-up members, wherein a first take-up member provides storage for the strap and a second take-up member provides a way of tightening the strap when in use. When the strap receives an impact, the second take-up member reacts more of the impact than does the first take-up member, thus the first take-up member can be more light duty.

In some examples, a safety barrier system with a flexible strap includes an incremental stop mechanism that provides the strap with a plurality of spaced-apart stopping points, whereby the strap does not have to rely on friction to resist an impact.

In some examples, a safety barrier system includes a first take-up member for storing an impactable strap, an incremental stop mechanism for providing the strap with a plurality of spaced-apart stopping points, and a second take-up member for adjusting the tension in the strap with infinite adjustability.

In some examples, a safety barrier system includes a take-up member that tilts 90 degrees to facilitate extending or retracting a flexible barrier.

In some examples, a flexible barrier includes a power-assist take-up member that responds a controller mounted to the distal end of the barrier.

In some examples, a flexible barrier includes a power-assist take-up member that is automatically energized by manually tugging on the distal end of a flexible barrier.

In some examples, a flexible barrier is tightened first by a spring or motor and then further tightened by a manual crank mechanism.

In some examples, a gear assembly can be selectively configured to provide: a) high torque and low rotational speed or b) low torque and high rotational speed.

In some examples, a gear assembly for retracting a flexible barrier can be disengaged to facilitate rapid deployment of the barrier.

In some examples, a common crank can be used to selectively engage and drive two different gears of a gear assembly.

In some examples, the gear assembly and a tilt-stop can be selectively installed at choice locations for right-hand or left-hand use.

In some examples, the gear assembly for cranking a barrier take-up member is a worm drive that also serves as an anti-rotation mechanism that prevents tension in the barrier from driving the take-up member in reverse.

In some examples, the barrier system includes an intermediate support post that can be temporarily installed on the open flat bed of a truck or trailer so that the barrier can extend from a stationary point on the loading dock over to the vehicle.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A barrier system that is mountable to a floor, the barrier system comprising:

a first support member that is vertically elongate and mountable to the floor;

a second support member to be spaced apart from the first support member, the second support member is vertically elongate and mountable to the floor;

a take-up member to be coupled to the first support member such that the take-up member is rotatable about a generally vertical axis;

a first flexible barrier that includes a proximal end attached to the take-up member and a distal end that can be releasably coupled to the second support member, by virtue of the take-up member being rotatably coupled to the first support member, the first flexible barrier is selectively movable between a stored position wrapped upon the take-up member and an operative position extending between the first support member and the second support member; and a gear assembly comprising a drive gear and a driven gear; and a manual crank connectable to the drive gear, wherein the manual crank is selectively connectable to the drive gear and the driven gear and the gear assembly is selectively operable in an engaged mode and a disengaged mode such that:

a) in the engaged mode, the driven gear is coupled to the take-up member and meshes with the drive gear such that the driven gear and the take-up member rotate slower than the drive gear; and b) in the disengaged mode, the take-up member is effectively decoupled from the drive gear to enable the take-up member to rotate independently of the drive gear.

2. The barrier system of claim 1, further comprising:

a second flexible barrier;

a second take-up member supporting the second flexible barrier and being rotatably mounted to a third support member; and an intermediate coupling to couple the first flexible barrier to the second flexible barrier such that the distal end of the first flexible barrier is couplable to the third support member via a combination of the intermediate coupling, the second flexible barrier, and the second take-up member.

3. A barrier system that is mountable to a floor, the barrier system comprising:

a first support member that is vertically elongate and mountable to the floor;

a second support member to be spaced apart from the first support member, the second support member is vertically elongate and mountable to the floor;

a take-up member to be coupled to the first support member such that the take-up member is rotatable about a generally vertical axis, the take-up member is rotatable about a generally horizontal axis to selectively rotate the take-up member between an upright position and a laid-over position;

a first flexible barrier that includes a proximal end attached to the take-up member and a distal end that can be releasably coupled to the second support member, by virtue of the take-up member being rotatably coupled to the first support member, the first flexible barrier is selectively movable between a stored position wrapped upon the take-up member and an operative position extending between the first support member and the second support member; and a gear assembly comprising a drive gear and a driven gear, the gear assembly being selectively operable in an engaged mode and a disengaged mode such that:

a) in the engaged mode, the driven gear is coupled to the take-up member and meshes with the drive gear such that the driven gear and the take-up member rotate slower than the drive gear; and b) in the disengaged mode, the take-up member is effectively decoupled from the drive gear to enable the take-up member to rotate independently of the drive gear.

4. The barrier system of claim 3, further comprising a latch connectable to at least one of the first support member or the take-up member, the latch to help hold the take-up member at the laid-over position.

5. The barrier system of claim 3, further comprising a stop mountable to the first support member at a first location, the take-up member to limit the rotation of the take-up member about the generally horizontal axis upon engaging the stop at the first location.

6. The barrier system of claim 5, wherein the stop is selectively mountable to the first support member at the first location and a second location, the take-up member to limit the rotation of the take-up member about the generally horizontal axis upon engaging the stop at the second location.

7. The barrier system of claim 3, further comprising a manual crank connectable to the drive gear.

8. The barrier system of claim 7, further comprising a holder on the first support member, the manual crank is selectively connectable to the drive gear and the holder such that the manual crank connected to the drive gear facilitates manually rotating the take-up member, and the manual crank connected to the holder facilitates storing the manual crank.

9. A barrier system that is mountable to a floor, the barrier system comprising:

a first support member that is vertically elongate and mountable to the floor;

a second support member to be spaced apart from the first support member, the second support member is vertically elongate and mountable to the floor;

a take-up member to be coupled to the first support member such that the take-up member is rotatable about a generally vertical axis;

a first flexible barrier that includes a proximal end attached to the take-up member and a distal end that can be releasably coupled to the second support member, by virtue of the take-up member being rotatably coupled to the first support member, the first flexible barrier is selectively movable between a stored position wrapped upon the take-up member and an operative position extending between the first support member and the second support member;

an electric switch at the second support member to respond to the distal end of the first flexible barrier being coupled to the second support member; and a gear assembly comprising a drive gear and a driven gear, the gear assembly being selectively operable in an engaged mode and a disengaged mode such that:

a) in the engaged mode, the driven gear is coupled to the take-up member and meshes with the drive gear such that the driven gear and the take-up member rotate slower than the drive gear; and b) in the disengaged mode, the take-up member is effectively decoupled from the drive gear to enable the take-up member to rotate independently of the drive gear.

10. The barrier system of claim 9, further comprising a manual crank selectively connectable to the take-up member to facilitate manual rotation thereof.

11. The barrier system of claim 10, wherein a turning ratio of the manual crank to the take-up member is 1:1.

12. A barrier system that is mountable to a floor, the barrier system comprising:

a first support member that is vertically elongate and mountable to the floor;

a second support member spaced apart from the first support member, the second support member is vertically elongate and mountable to the floor;

a take-up member coupled to the first support member such that the take-up member is rotatable about a generally vertical axis, the take-up member is also rotatable about a generally horizontal axis for selectively rotating the take-up member between an upright position and a laid-over position;

a flexible barrier that includes a proximal end attached to the take-up member and a distal end that can be releasably coupled to the second support member, by virtue of the take-up member being rotatably coupled to the first support member, the flexible barrier is selectively movable between a stored position wrapped upon the take-up member and an operative position extending between the first support member and the second support member; and a worm drive comprising a worm and a worm gear, the worm drive is coupled to the first support member and having an engaged mode and a disengaged mode:

a) in the engaged mode, the worm is coupled to the take-up member via the worm gear; and b) in the disengaged mode, the take-up member is effectively decoupled from the worm to enable the take-up member to rotate independently of the worm.

13. The barrier system of claim 12, wherein the worm is rotatable about an axis that defines an axial direction, and the worm is movable in the axial direction between an engaged position meshing with the worm gear and a disengaged position effectively decoupled from the worm gear to selectively configure the worm drive in the engaged mode and the disengaged mode respectively.

14. The barrier system of claim 12, further comprising a crank selectively connectable to the worm and the worm gear.

15. The barrier system of claim 12, further comprising a bracket that connects the worm to the first support member, the bracket is selectively mountable to the first support member at two locations.

16. The barrier system of claim 12, further comprising a latch connectable to at least one of the first support member or the take-up member, wherein the latch helps hold the take-up member at the laid-over position.

17. The barrier system of claim 14, wherein the worm is rotatable about an axis that defines an axial direction, and the worm is movable in the axial direction between an engaged position meshing with the worm gear and a disengaged position effectively decoupled from the worm gear to selectively configure the gear assembly in the engaged mode and the disengaged mode respectively.

18. The barrier system of claim 12, further comprising a catch associated with the worm to retain or hold the worm in the disengaged position.

19. The barrier system of claim 12, wherein a gear ratio between the worm and the worm gear enables self-locking of the take-up roller.

20. The barrier system of claim 16, further comprising:

a bracket to connect the worm to the first support member, the bracket being selectively mountable to the first support member at two locations.

* * * * *